US007605530B2

(12) United States Patent
Nomura et al.

(10) Patent No.: US 7,605,530 B2
(45) Date of Patent: Oct. 20, 2009

(54) IMAGE-FORMING DEVICE USING ELECTRON-EMITTING ELEMENTS

(75) Inventors: Ichiro Nomura, Kanagawa-ken (JP); Hidetoshi Suzuki, Kanagawa-ken (JP); Tetsuya Kaneko, Kanagawa (JP); Shinya Mishina, Shiga-ken (JP); Naoto Nakamura, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/740,496

(22) Filed: Apr. 26, 2007

(65) Prior Publication Data

US 2007/0285357 A1 Dec. 13, 2007

Related U.S. Application Data

(60) Division of application No. 10/756,452, filed on Jan. 14, 2004, now Pat. No. 7,230,589, which is a division of application No. 09/987,309, filed on Nov. 14, 2001, now Pat. No. 6,705,909, which is a division of application No. 09/145,208, filed on Sep. 1, 1998, now Pat. No. 6,366,265, which is a continuation of application No. 08/321,465, filed on Oct. 11, 1994, now Pat. No. 5,828,352, which is a continuation of application No. 07/913,483, filed on Jul. 14, 1992, now abandoned.

(30) Foreign Application Priority Data

Jul. 17, 1991 (JP) ..... 3-201162

(51) Int. Cl.
*H01J 1/62* (2006.01)
*H01J 1/88* (2006.01)

(52) U.S. Cl. ..... 313/495; 313/292

(58) Field of Classification Search ..... 313/495–497, 313/292

See application file for complete search history.

(56) References Cited

U.S. PATENT DOCUMENTS 3,755,704 A 8/1973 Spindt, et al. ..... 313/309

(Continued)

FOREIGN PATENT DOCUMENTS

EP 0 201 609 11/1986

(Continued)

OTHER PUBLICATIONS

M. I. Elinson, et al. "The Emission of Hot Electrons and the Field Emission of Electrons From Tin Oxide", Radio Engineering and Electronic Physics, pp. 1290-1296 (Jul. 1965).

(Continued)

*Primary Examiner*—Joseph L Williams
(74) *Attorney, Agent, or Firm*—Fitzpatrick, Cella, Harper & Scinto

(57) ABSTRACT

An image-forming device includes, in an envelope, an electron-emitting element for emitting an electron by applying a voltage between electrodes, an image-forming member for forming an image by irradiation with an electron beam emitted from the electron-emitting element, and a supporting member for supporting the envelope. The supporting member has an electroconductive film at an end portion and a side portion thereof, and is electrically connected through the electroconductive film to the electrode.

4 Claims, 32 Drawing Sheets

U.S. PATENT DOCUMENTS

| | | | | | |
|---|---|---|---|---|---|
| 4,451,759 | A | | 5/1984 | Heynisch | 313/495 |
| 4,769,575 | A | * | 9/1988 | Murata et al. | 313/495 |
| 4,904,895 | A | | 2/1990 | Tsukamoto et al. | 313/336 |
| 4,988,913 | A | | 1/1991 | Kawauchi et al. | 313/422 |
| 5,015,912 | A | * | 5/1991 | Spindt et al. | 313/495 |
| 5,063,327 | A | | 11/1991 | Brodie et al. | 313/482 |
| 5,066,883 | A | | 11/1991 | Yoshioka et al. | 313/495 |
| 5,229,691 | A | | 7/1993 | Shichao et al. | 315/366 |
| 5,245,249 | A | | 9/1993 | Sakurai et al. | 315/3 |
| 5,347,292 | A | | 9/1994 | Ge et al. | 345/74 |
| 5,386,175 | A | | 1/1995 | Van Gorkom et al. | 313/422 |
| 5,424,605 | A | | 6/1995 | Lovoi | 313/422 |
| 5,430,459 | A | | 7/1995 | Clerc | 345/74 |
| 5,606,225 | A | | 2/1997 | Levine et al. | 315/169.3 |
| 5,726,529 | A | | 3/1998 | Dean et al. | 313/495 |
| 5,757,123 | A | | 5/1998 | Nomura et al. | 313/495 |
| 5,760,538 | A | | 6/1998 | Mitsutake et al. | 313/422 |
| 5,828,352 | A | | 10/1998 | Nomura et al. | 345/74 |
| 6,011,567 | A | | 1/2000 | Nakamura et al. | 347/115 |
| 6,157,123 | A | | 12/2000 | Schmid et al. | 313/422 |

FOREIGN PATENT DOCUMENTS

| | | | |
|---|---|---|---|
| EP | 0 405 262 | | 1/1991 |
| JP | 361124031 | A * | 6/1986 |
| JP | 6-441150 | | 2/1989 |
| WO | WO/9000808 | | 1/1990 |

OTHER PUBLICATIONS

G. Dittmer, "Electrical Conduction and Electron Emission of Discontinuous Thin Films", Thin Solid Films, 9, pp. 317-328 (1972).

M. Hartwell, et al., "Strong Electron Emission From Patterned Tin-Indium Oxide Thin Films", International Electron Devices Meeting, pp. 519-521 (1975).

* cited by examiner

IMAGE-FORMING DEVICE USING ELECTRON-EMITTING ELEMENTS

This is a divisional application of application Ser. No. 10/756,452, filed on Jan. 14, 2004, which is a divisional of application Ser. No. 09/987,309, filed on Nov. 14, 2001, which is a divisional of application Ser. No. 09/145,208, filed on Sep. 1, 1998, now U.S. Pat. No. 6,366,265, issued on Apr. 2, 2002, which is a continuation of application Ser. No. 08/321,465, filed on Oct. 11, 1994, now U.S. Pat. No. 5,828, 352, issued Oct. 27, 1998, which is a continuation of application Ser. No. 07/913,483, filed on Jul. 14, 1992, now abandoned.

BACKGROUND OF THE INVENTION

1. Field of the Invention

The present invention relates to an image-forming device employing electron-emitting elements.

2. Related Background Art

Hitherto thin plate-type image-forming devices have been used, in which a plurality of electron-emitting elements are arranged in a plane and are counterposed to image-forming members for forming images by electron beam irradiation (a member which emits light, changes its color, become electrified, or denaturated by collision of electrons, e.g., a fluorescent material, and a resist material). FIGS. 35 and 36 show an outline of construction of a conventional electron beam display device as an example of the image-forming device. FIG. 36 shows a sectional view at A-A' in FIG. 35.

The construction of the conventional electron-beam display device shown in FIGS. 35 and 36 is described below in detail. A rear plate 101, an external frame 111, and a face plate 109 constitute an envelope. The interior of the envelope is maintained in vacuum. Electrodes 103*a* and 103*b*, and an electron-emitting section 104 constitute an electron-emitting element 105. A scanning electrode 102*a* and an information signal electrode 102*b* are wiring electrodes, and are connected respectively to the electrodes 103*a* and 103*b*. A glass substrate 106, a transparent electrode 107, and a fluorescent material (an image-forming member) 108 constitute the face plate 109. The numeral 112 indicates a luminescent spot, and the numeral 110 indicates a supporting member for supporting the envelope against the atmospheric pressure. The electron-beam display device displays an image by application of signal voltages between scanning electrodes 102*a* and information signal electrodes 102*b* arranged in an X-Y matrix to project an electron beam onto the fluorescent material 108 in correspondence with information signals. As the electron-emitting element 105, useful are thermoelectron-emitting elements in which electrons are emitted from the electron-emitting section 104 on heating; field emission elements disclosed in U.S. Pat. No. 3,755,704 and U.S. Pat. No. 4,904, 895; and surface conduction type emitting elements disclosed in U.S. Pat. No. 5,066,883.

In the above-described plane type electron beam display device, the inside of the envelope is kept at a vacuum. A supporting member 110 is provided between the rear plate 101 and the face plate 109 as shown in FIG. 36 to support the envelope internally against the external atmospheric pressure. The supporting member 110 is usually made of an insulating material to give dielectric strength against high voltage applied between the fluorescent material 108 (or the transparent electrode 107) and the electron-emitting element 105. The supporting member is indispensable for simplification, miniaturization, and weight reduction of the entire device, since an electron beam display device having a larger display surface is subjected to a larger total atmospheric pressure.

However, conventional electron beam display devices mentioned above, as shown in FIGS. 35 and 36, have a supporting member 110 made of an insulating material, which will be electrified at the surface by undesired collision of electrons and ions thereto. The electrification of the supporting member causes the problems as below: (1) The electron beam is deflected owing to the electrification, whereby the quantity of irradiation of electron beam onto the desired fluorescent material in the picture elements fluctuates to cause irregularity in luminance and color. In particular, when the quantity of the electrification is large, the electron beam is not projected to the desired fluorescent material but is directed to undesired adjacent fluorescent material to cause crosstalk; (2) The quantity of electrification varies with lapse of time, which causes time-variation of the electron path, resulting in variation in the intensity of the luminance; and (3) Electric discharge occurs at the electrified supporting member, which may damage the electron-emitting element or deteriorate the insulating property of the supporting member.

For preventing the above electrification of the supporting member by the electron beam, for example, the insulating material portion of the supporting member 110 is surrounded with a metal cover 113 as shown in FIG. 37 (sectional view) (Japanese Patent Application Laid-Open No. 64-41150). In FIG. 37, the metal cover 113 is fixed by a member 114 at the supporting member 110. The metal cover 113 is connected electrically to a transparent electrode 107. Thereby, the metal cover 113 is kept at the same voltage as the transparent electrode (fluorescent material 108). Generally, the transparent electrode 107 is kept at a high potential so as to capture the electron beam. When the metal cover is kept at a high potential is placed in proximity to the electron-emitting element 105, the electron beam emitted from the electron-emitting element 105 is deflected toward the side of the metal cover 113, causing different problems mentioned below: (4) A fraction of the electron beam is captured by the metal cover, whereby the intensity of the electron beam is lowered and the luminance of the fluorescent material is lowered at the proximity to the supporting member, causing irregularity of the luminance; and (5) The potential applied to the transparent electrode (fluorescent material) cannot exceed a certain value, whereby the luminance is low, red-light emitting and blue-light emitting fluorescent material cannot be used, and therefore a full-color image cannot be displayed.

SUMMARY OF THE INVENTION

An object of the present invention is to provide an image-forming device having a sufficient supporting structure to withstand the atmospheric pressure, being free from cross talk, and being improved in picture image contrast and in uniformity of the luminance.

Another object of the present invention is to provide a stable image-forming device which is free from time-variation of the luminance.

A further object of the present invention is to provide an image-forming device which gives a color image with high contrast or with high luminance.

A still further object of the present invention is to provide an image-forming device which is free from discharging of the supporting member, and has a long life.

According to an aspect of the present invention, there is provided an image-forming device having, in an envelope, an electron-emitting element, an image-forming member for forming an image by irradiation of an electron beam emitted from the electron-emitting element, and an electroconductive supporting member for supporting the envelope (internally), wherein the device comprises a means for controlling the potential of the supporting member to not be higher than the maximum potential applied to the electron-emitting element.

According to another aspect of the present invention, there is provided an image-forming device having, in an envelope, an electron-emitting element for emitting an electron beam by application of voltage between electrodes, an image-forming member for forming an image by irradiation of the electron beam emitted from the electron-emitting element, and an electroconductive supporting member for supporting the envelope, wherein the supporting member is connected electrically to one of the electrodes.

According to still another aspect of the present invention, there is provided an image-forming device having, in an envelope, an electron-emitting element for emitting an electron beam on application of voltage between electrodes, an image-forming member for forming an image by irradiation of the electron beam emitted from the electron-emitting element, and an electroconductive supporting member for supporting the envelope, wherein the supporting member is connected electrically to a lower potential electrode of said electrodes.

According to a further aspect of the present invention, there is provided an image-forming device having, in an envelope, an electron-emitting element, an image-forming member for forming an image by irradiation of an electron beam emitted from the electron-emitting element, and an electroconductive supporting member for supporting the envelope, wherein the electron-emitting element and the image-forming member are placed in juxtaposition on the same substrate, a potential-defining electrode is additionally provided in opposition to the substrate to define the potential of the space where the electron beam is emitted, and the supporting member is connected electrically to the potential-defining electrode.

According to a still further aspect of the present invention, there is provided an image-forming device having, in an envelope, an electron-emitting element for emitting an electron beam by application of voltage between electrodes, an image-forming member for forming an image by irradiation of the electron beam emitted from the electron-emitting element, and an electroconductive supporting member for supporting the envelope, wherein the electron-emitting element and the image-forming member are placed in juxtaposition on the same substrate, an electroconductive substrate is additionally provided in opposition to the face of said substrate, and the supporting member is connected electrically to one of said electrodes and also to the electroconductive substrate.

DESCRIPTION OF THE PREFERRED EMBODIMENT

The main feature of the present invention is to provide a supporting member kept at a controlled potential. The supporting member of the present invention is not only capable of improving the atmospheric pressure resistance of the envelope and preventing electrification of the surface of the supporting member, but also has functions of suppressing the time-variation of the path and intensity of the electron beam emitted by the electron-emitting element toward an image-forming member, and of ensuring efficient irradiation of the electron beam to the predetermined image-forming member.

The inventors of the present invention have found that a supporting member having simultaneously the above functions is most suitable in simplification, miniaturization and weight-reduction of the entire device because the above functions are required more for a larger image-forming face (larger picture) of the device, and a larger picture of the device necessitates more the supporting member as a constitutional member. Therefore, the inventors investigated the optimum potential to be applied to the supporting member for imparting the above functions to the supporting member as below.

Figure 3:
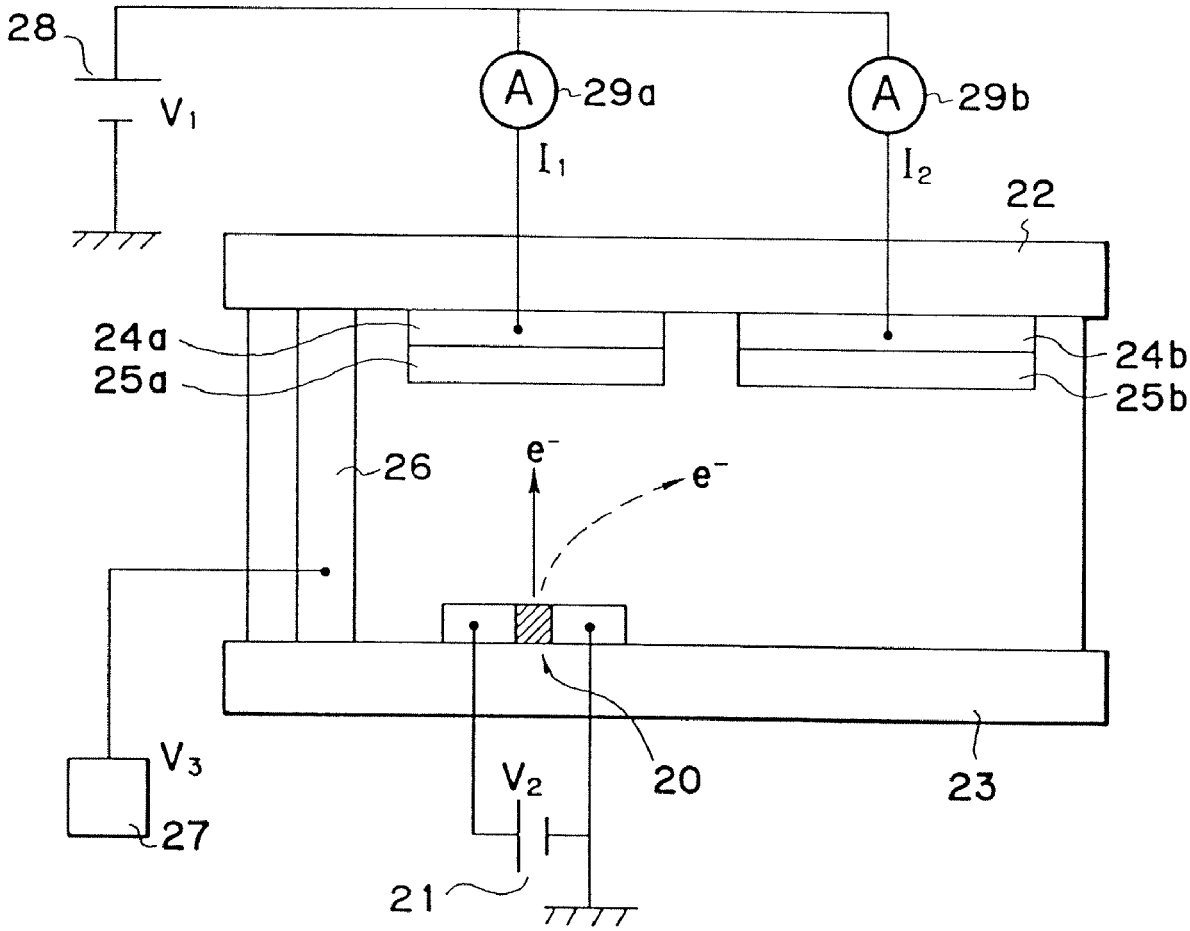
FIG. 3 is a rough sketch of an evaluation device regarding the potential applied to an electroconductive supporting member.

FIG. 3 shows the evaluation device employed in the investigation. The device as shown in FIG. 3, has fluorescent materials 25*a*, 25*b*; transparent electrodes 24*a*, 24*b* for capturing electron beam projected to the fluorescent materials 25*a*, 25*b*; a power source 28 for applying a voltage $V_1$ to the transparent electrodes; a face plate 22; ammeters 29*a*, 29*b* for measuring electric current flowing in each of the fluorescent materials (hereinafter the current flowing in the fluorescent material 25*a* is referred to as "picture element current $I_1$" and the current flowing in the fluorescent material 25*b* is referred to as "crosstalk current $I_2$"), an electron-emitting element 20 placed on a rear plate 23 counter to the fluorescent body 25*a*, a power source 21 for applying a voltage $V_2$ to the electron-emitting element 20, and a supporting member 26 suitably placed near the electron-emitting element 20. The supporting member 26 is made of an insulating material or an electroconductive material. If the supporting member is made of an electroconductive material, a potential $V_3$ is applied to the supporting member by a power source 27.

Evaluation is conducted with the evaluation device of FIG. 3 as below.

Figure 4:
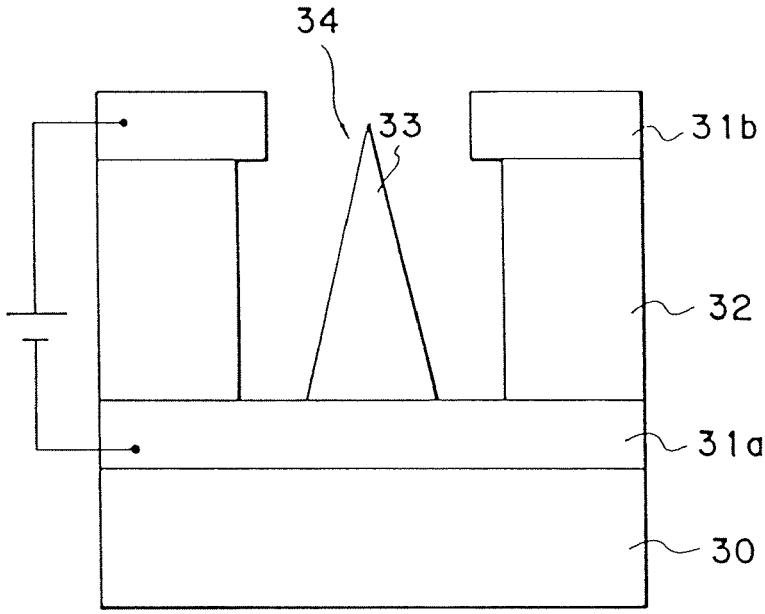
FIG. 4 (PRIOR ART)
FIG. 4 is a rough sketch of a conventional vertical type field-emission element.
Figure 5:
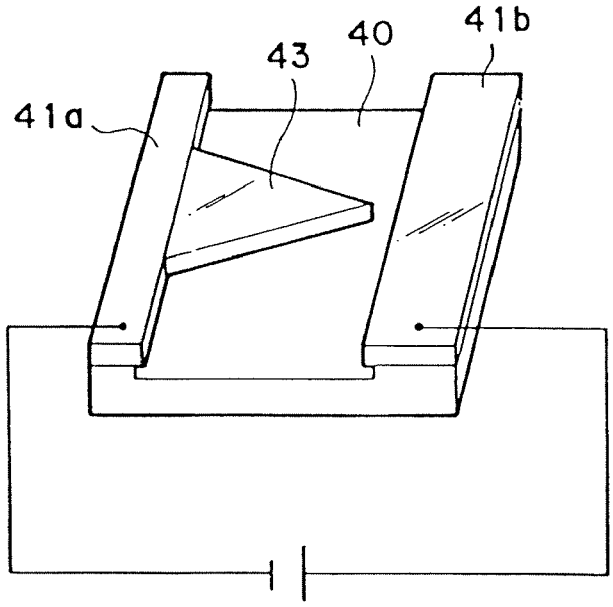
FIG. 5 (PRIOR ART)
FIG. 5 is a rough sketch of a conventional horizontal type field-emission element.

The electron-emitting elements employed are classified into: (a) surface-conduction type emitting elements as described later in Embodiments, (b) vertical type field-emitting elements as described in U.S. Pat. No. 3,755,704, and (c) horizontal type field-emitting elements as described in U.S. Pat. No. 4,904,895. The construction of the above electron-emitting elements (b) and (c) is roughly shown in FIG. 4 and FIG. 5. The vertical type field-emitting element shown in FIG. 4 (sectional view) is constructed from a substrate 30, a pair of a low potential electrode 31*a* and high potential electrode 31*b* with interposition of an insulating layer 32 therebetween, and an electron-emitting section 33 which is provided at the opening 34 of the high potential electrode 31*b* and insulating layer 32 and is electrically connected with the low potential electrode 31*a*. This vertical type field-emitting element emits an electron beam from the electron emitting section 33 on application of a prescribed voltage. The horizontal type field emitting electrode shown in FIG. 5 is constructed from a substrate 40, a pair of a low potential electrode 41*a* and a high potential electrode 41*b*, and an electron-emitting section 43 which is electrically connected with the low potential electrode 41*a* and is placed parallel to the substrate 40 without contacting thereto. The lateral type field-emitting element emits an electron beam from the electron-emitting section on application of a prescribed voltage between the electrodes 41*a* and 41*b*. The above electron-emitting elements (b) and (c) emit an electron beam from the tip of the electron-emitting section generally on application of a voltage as high as from 50 V to 200 V, whereby electrons are projected with a velocity component directing to the high potential electrode 31*b* or 41*b*.

Evaluation I-1

With the electron-emitting element 20 of the above electron-emitting element (a) and the supporting member 26 made of an insulating material, the time-variation of the picture element current $I_1$ and the crosstalk current $I_2$ were observed at a $V_1$ value within a range of from 1 kV to 4 kV, a $V_2$ value within a range of from 5 V to 30 V, and a vacuum degree of the device within a range of from $2\times10^{-5}$ to $3\times10^{-7}$ torr. The result of the observation is shown in FIG. 6.

Figure 6:
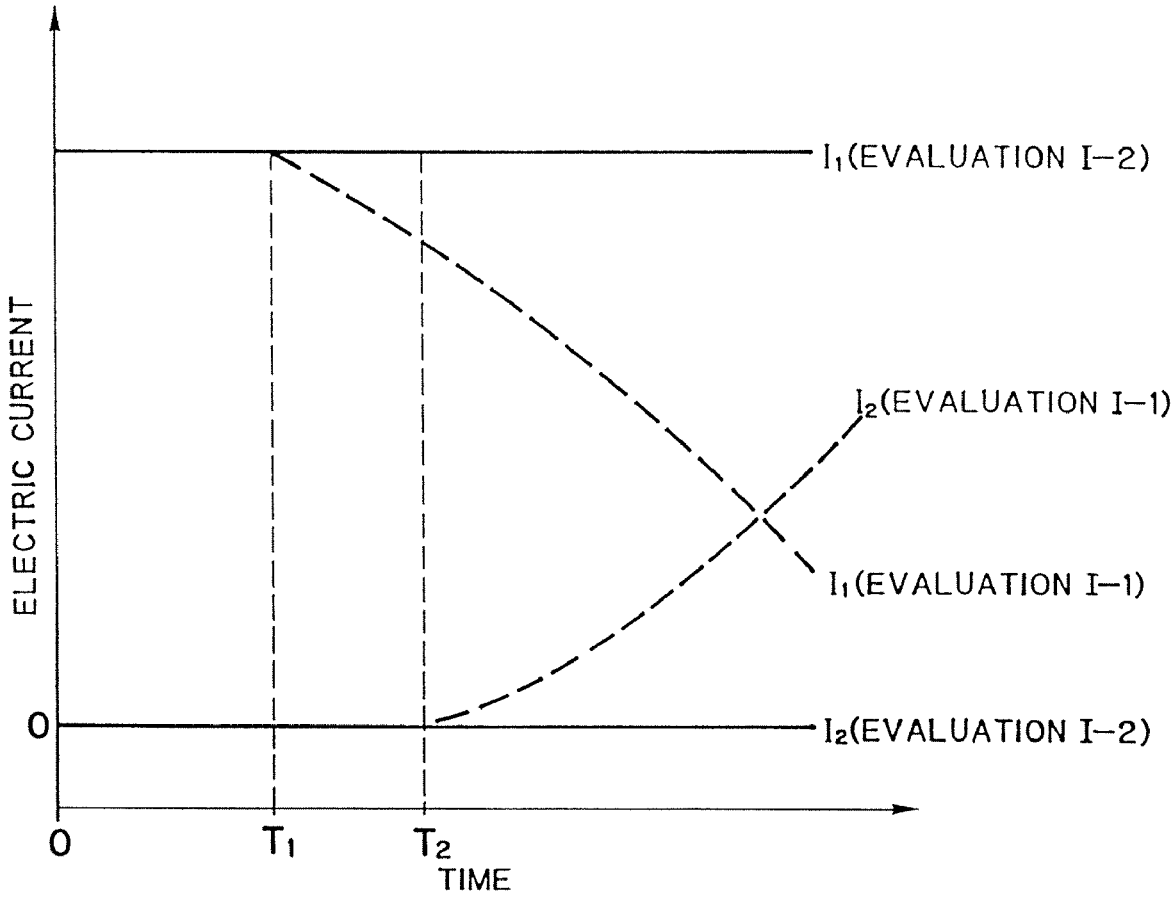
FIGS. 6 and 7 are graphs showing the evaluation results regarding the potential applied to electroconductive supporting member by use of the evaluation device shown in FIG. 3.

FIG. 6 shows that, when an insulating supporting member is used, the picture element current $I_1$ rapidly decreased after the driving for a certain time ($T_1$), and crosstalk current $I_2$ rapidly increased after the driving for a certain time ($T_2$). The time lengths of $T_1$ and $T_2$ depend on the vacuum degree in the device, $V_1$, and $V_2$. Within the aforementioned ranges, nearly the same tendency as shown in FIG. 6 was obtained at $T_1$ of from 1 second to 60 minutes, and at $T_2$ of from several minutes to 120 minutes. Such phenomena of the decrease of picture element current $I_1$ and generation of the crosstalk current $I_2$ were similarly observed with the electron-emitting elements (b) and (c).

Evaluation I-2

With an electroconductive supporting member as the supporting member 26, the time-variation of the picture element current $I_1$ and the crosstalk current $I_2$ is evaluated in the same manner as in Evaluation I-1 except that $V_3$ was set within a range of from −30 V to 30 V. The results are shown in FIG. 6. As shown in FIG. 6, in the case where an electroconductive supporting member is used, no time variation is observed in the picture element current $I_1$ and the crosstalk current $I_2$ regardless of the set values of the vacuum degree of the device, $V_1$, $V_2$ and $V_3$. Thus in this image-forming device employing an electroconductive supporting member, neither time-variation of electron beam irradiation to the respective picture elements for forming a picture image nor undesired electron beam irradiation to the picture elements occurs, thereby satisfactory uniformity in image contrast and image luminance being achieved without occurrence of crosstalk.

Evaluation II-1

Figure 7:
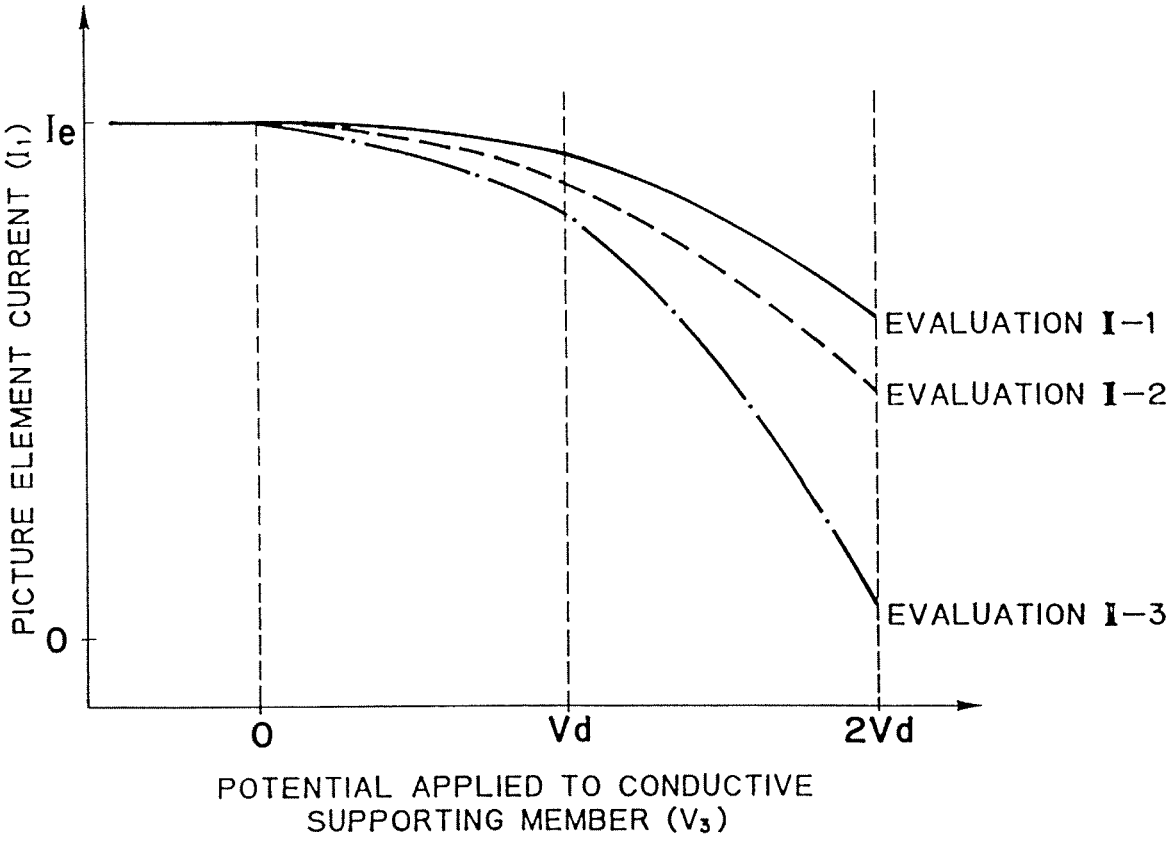

With the above electron-emitting element 20 of the above (a) and the supporting member 26 made of an electroconductive material, the dependence of the picture element current $I_1$ on $V_3$ is evaluated in a range of from −30 V to 30 V at the values of the vacuum degree of the device, $V_1$, and $V_2$ arbitrarily set within the same range as in Evaluation I-1. The result is shown in FIG. 7.

Evaluation II-2

With the above electron-emitting element of (b) as the electron-emitting element 20, the picture element current $I_1$ is measured in the same manner as in Evaluation II-1 except that $V_2$ is arbitrarily set within a range of from 50 V to 200 V, and $V_3$ is changed from −50 V to 200 V. The result is shown in FIG. 7.

Evaluation II-3

With the above electron-emitting element (c) as the electron-emitting element 20, the picture element current $I_1$ is measured in the same manner as in Evaluation II-2. The result is shown in FIG. 7.

The results of the Evaluations II-1 to II-3 are summarized in FIG. 7, where Ie denotes the maximum picture element current, and Vd denotes the $V_2$ value set, in the above conditions for the respective Evaluations. In the above Evaluations, $V_2$ is equal to the maximum potential applied to the electron-emitting element employed since the low potential electrode is set at a potential of zero volt.

As shown in FIG. 7, each of the lines in FIG. 7 has two inflection points at $V_3$=0 V and $V_3$=Vd, independently of the kind of electron-emitting element, and the set values of the vacuum degree of the device, $V_1$, and $V_2$ within the above ranges: at the $V_3$ value of 0 V or lower, the picture element current $I_1$ is kept unchanged at Ie; at the $V_3$ value in the range of from 0 V to Vd, the picture element current $I_1$ decreases slightly; and at the $V_3$ value exceeding Vd, the picture element current $I_1$ decreases remarkably.

The inventors of the present invention found, as described above, that the efficiency of electron beam irradiation onto an image-forming member, and unexpected electron beam irradiation onto an adjacent image-forming member (crosstalk) depend greatly on an electron-emitting voltage ($V_2$) applied to an electron-emitting element and a voltage ($v_3$) applied to a supporting member. The inventors further found that the above irradiation efficiency and the crosstalk are remarkably improved by controlling the potential of the supporting member not to exceed the maximum potential (Vd) applied so as to control the electron-emitting element, and consequently accomplished the present invention.

The means for controlling the potential of the supporting member are classified into (a) voltage-applying means for applying an electron-emitting voltage to an electron-emitting element, and (b) separate voltage applying means provided independently of the voltage-applying means for applying an electron-emitting voltage to an electron-emitting element.

In the voltage-applying means (a), the potential of the supporting member is controlled at a desired value by connecting one of the electron-emitting element electrode (a pair of electrodes for applying a voltage to the electron-emitting section). In this case, the supporting member is preferably connected to the low potential electrode of the electrode pair.

In the voltage applying means (b), another potential-applying means in the device may be utilized which is capable of controlling the potential of the supporting member, but a voltage-application means may be independently provided for the purpose only and be connected electrically to the supporting member. In such a case, the applied voltage is preferably not higher than 0 V (not higher than the potential of the lower potential electrode of the electron-emitting element) as is clear from the results of the above investigation.

Other construction members of an image-forming member of the present invention are described below in detail.

The electron-emitting element may be either a hot cathode or a cold cathode which are employed in conventional image-forming devices. However, with the hot cathode, the electron emitting efficiency and the response rate will decrease owing to diffusion of heat to the substrate supporting the cathode. Furthermore, the image-forming member may deteriorate by action of heat. Therefore, the density of arrangement of the hot cathodes and the image-forming members is limited. From the consideration above, as the electron-emitting element, preferred are cold cathodes including surface conduction type emitting elements as described below, semiconductor type electron-emitting elements, and field emitting elements. From among these cold electrodes, particularly preferred are the surface conduction type emitting elements because of the advantages such as: (1) high electron-emitting efficiency, (2) ease of production of the element and high density of arrangement of the elements on a substrate because of the simple element structure; (3) high response rate; and (4) excellent contrast of luminance.

An example of the surface conduction type emitting elements is the cold cathode element disclosed by M. I. Elinson, et al. (Radio Eng. Electron Phys., Vol. 10, pp. 1290-1296 (1965). This element, generally called a surface conduction type electron-emitting element, utilizes electron emission phenomenon caused by an electric current flowing in a thin film formed in a small area on a substrate in a direction parallel to the thin film. The surface conduction type electron-emitting element includes those utilizing a thin film of $SnO_2$ developed by Elinson et al. (loc. cit), those utilizing a thin film of Au (G. Dittmer: "Thin Solid Films", Vol. 9, p. 317 (1972)), and those utilizing a thin film of ITO (M. Hartwell and C. G. Fonstad: "IEEE Trans. ED Conf" p. 519 1975).

Figure 8:
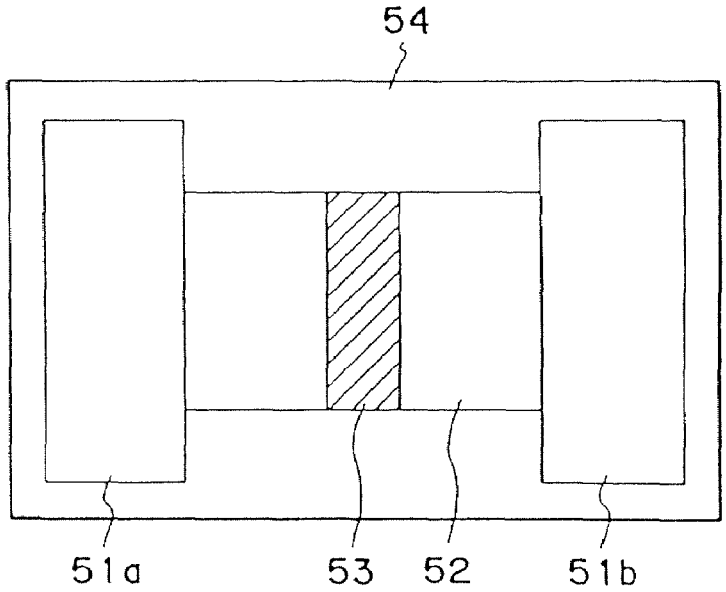
FIG. 8 (PRIOR ART)
FIGS. 8 and 9 are rough sketches of a conventional surface conduction type emitting element.
Figure 9:
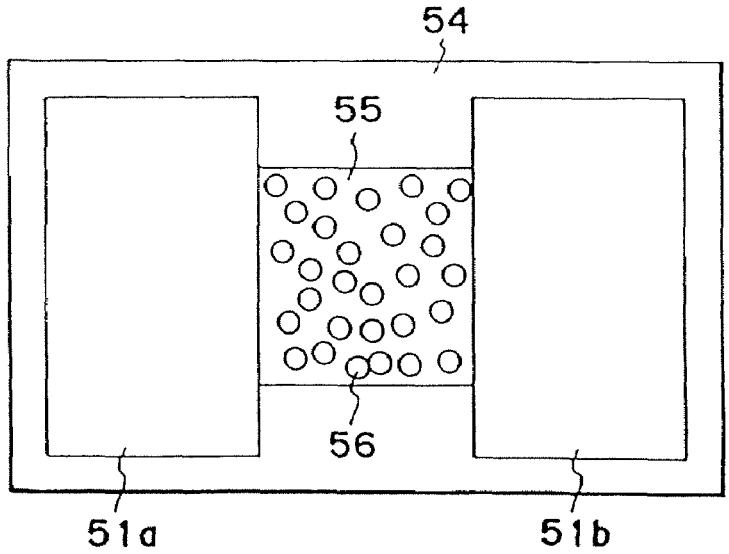
FIG. 9 (PRIOR ART)

The typical construction of such a surface conduction type electron-emitting element is illustrated in FIG. 8. The element comprises electrodes 51*a* and 51*b* for electric connection, a thin film 52 formed from an electron-emitting material, a substrate 54, and an electron-emitting section 53. In preparation of such a surface conduction electron-emitting element, an electron-emitting section is formed by electric heating treatment called a forming treatment before the use for the electron emission. In the forming treatment, a voltage is applied between the electrode 51*a* and the electrode 51*b* to flow electric current through the thin film 52, thereby the thin film 52 being locally destroyed, deformed, or destroyed by generated Joule's heat to form an electron-emitting section 53 in a high electric resistance state. Thus electron-emitting function is attained. Here, the "high electric resistance state" means a discontinuous state of the film that a crack of 0.5 μm to 5 μm long having an "island structure" is formed in a portion of the thin film 52. The island structure means generally a state of the film that fine particles of some tens of angstroms to several micron meters in diameter are disposed on a substrate and the particles are spacially discontinuous mutually but are electrically continuous. Conventional surface conduction type electron-emitting elements emit electrons from the above fine particles on application of voltage to the above high-resistance discontinuous film through the electrodes 51*a* and 51*b* to flow electric current on the surface of the elements The inventors of the present invention disclosed in U.S. Pat. No. 5,066,883 a novel surface conduction type electron-emitting element in which particles to emit electrons are scattered between the electrodes. This electron-emitting element is advantageously capable of giving higher electron-emitting efficiency than conventional surface conduction type emitting elements. FIG. 9 illustrates typical construction of the element. The element comprises electrodes 51*a* and 51*b* for electrical connection, a thin film (an electron-emitting section) 55 on which fine particles 56 of a size of 10 Å to 10 μm are scattered, and an insulating planar substrate 54. In particular, in FIG. 9, the thin film 55 has preferably a sheet resistance in a range of from $10^3$ Ω/square to $10^9$ Ω/square, and electrode interval in a range of from 0.01 μm to 100 μm.

As discussed above, various types of electron-emitting elements are useful in the present invention. Among them, the cold cathodes involve the notable disadvantages of decrease of electron-emitting efficiency, and crosstalk: cold cathodes such as surface conduction type emitting elements and field emitting elements in which initial velocity of emitted electrons are large; in particular, electron-emitting elements in which the initial velocity of emitted electrons is in a range of from 4.0 eV to 200 eV, and the electron beam is deflected from the perpendicular direction toward a high resistance electrode side because the electrons in a beam emitted from an electron-emitting section have velocity component directing to the high resistance electrode on application of a voltage. Hence, the technique of control of the potential of the supporting member according to the present invention is significantly effective in the image-forming device employing the above electron-emitting elements.

The image-forming member in the present invention may be made from any material which, on irradiation of electron-beam emitted for the electron-emitting element, causes luminescence, color change, electrification, denaturing, deformation, or a like change. The example of the material includes fluorescent materials and resist materials. In the case where fluorescent materials are used, the image formed is a luminescent image or a fluorescent image, and for formation of full-color luminescent image the image-forming member is formed from luminescent materials of three primary colors of red, green, and blue.

Figure 1:
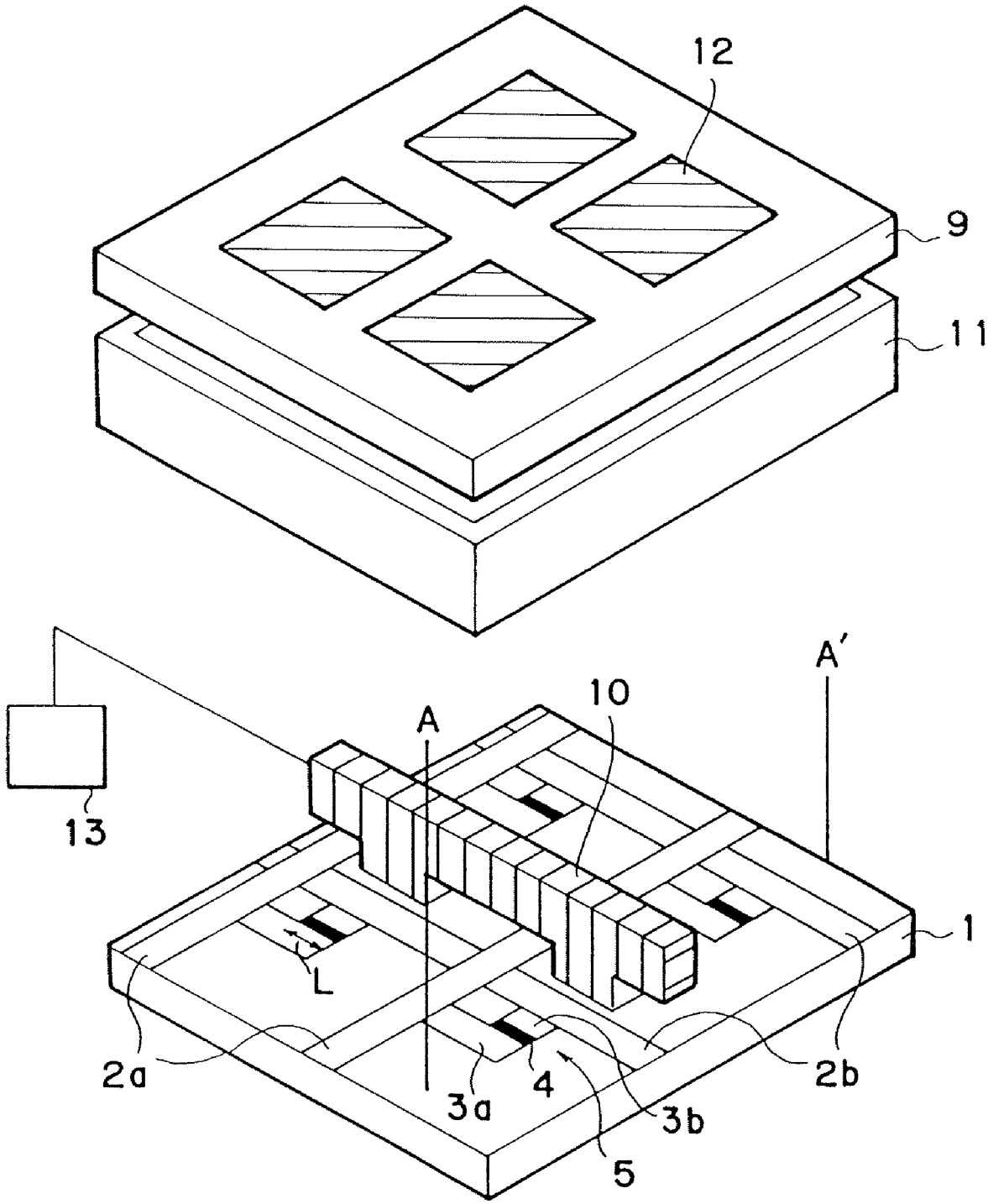
FIGS. 1 and 2, and FIGS. 10 to 16 are rough sketches of the image-forming devices of the present invention in which electron-emitting elements and image-forming members are placed in opposition.
Figure 2:
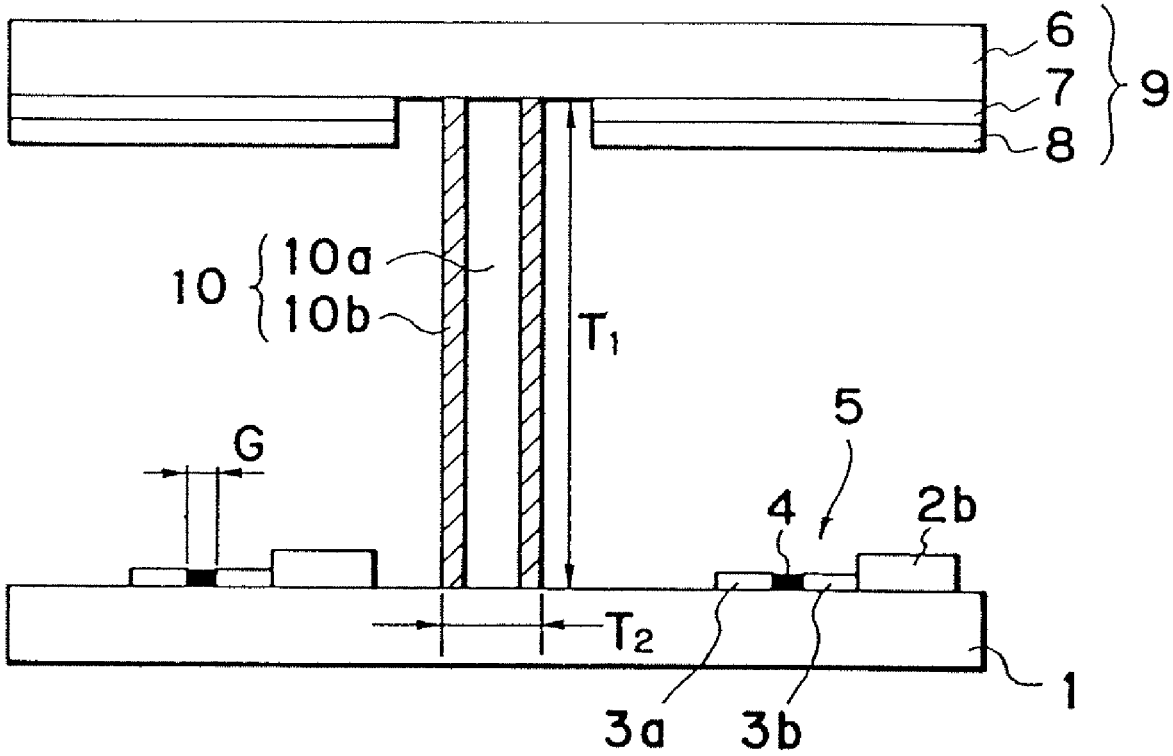
Figure 17:
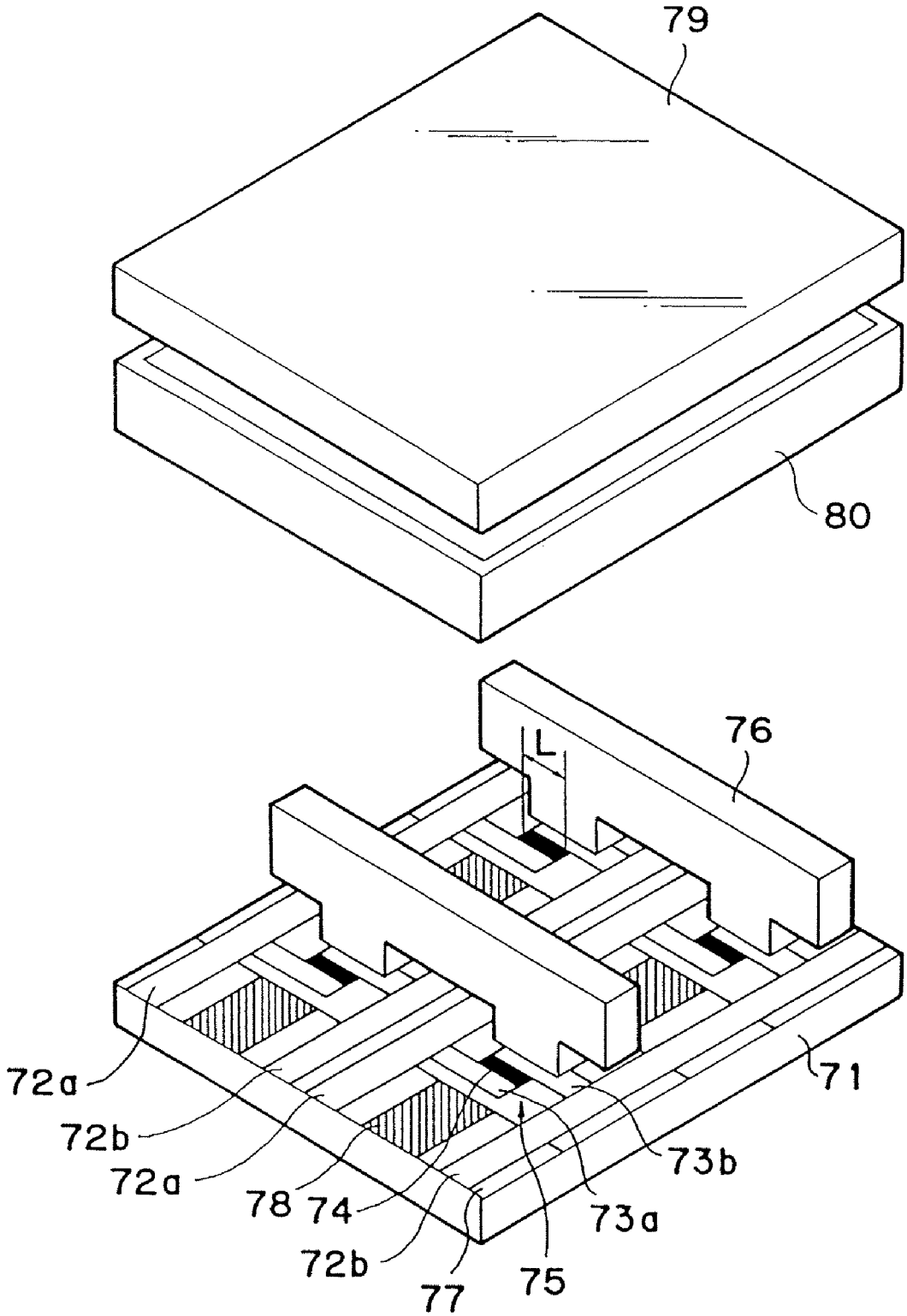
FIGS. 17 to 19, FIGS. 21 to 25, and FIGS. 27 to 29 are rough sketches of the image-forming members of the present invention in which electron-emitting elements and image-forming members are placed in juxtaposition on the same substrate face.

The electron-emitting element and the image-forming member are arranged in such manners as: (A) the electron-emitting elements 5 and the image-forming member 8 as shown in FIGS. 1 and 2 are respectively disposed on counterposed substrate faces 6 and 1 in an envelope; or (B) the electron-emitting elements 75 and the image-forming member 78 are disposed on the one and the same face of the substrate 71 as shown in FIG. 17. In the case of (B), since the positive ions generated by collision of emitted electrons collide less against the residual gas in the envelope, deterioration of the electron-emitting element is remarkably prevented, thereby giving longer life of the electron-emitting elements than in the case of (A). Furthermore, the arrangement as in the case of (B) is preferred particularly for the electron-emitting elements in which the electron beam is deflected from the perpendicular direction toward the high resistance electrode as in the case of surface conduction type emitting elements and field emitting elements.

The supporting member in the present invention may be a member constituted of an electroconductive material, or an insulating member such as glass which is coated with an electroconductive material. Otherwise the supporting member may be an insulating material on which electroconductivity is imparted partially. In this case, the electroconductivity-imparted region is placed in vicinity to the electron-emitting section of the electron-emitting element. Further, in the present invention, the supporting members can be arranged on any pattern provided they are capable of maintaining the envelope against atmospheric pressure. Consequently, it is not necessary for them to be stationed at every electron-emitting sections.

Figure 11:
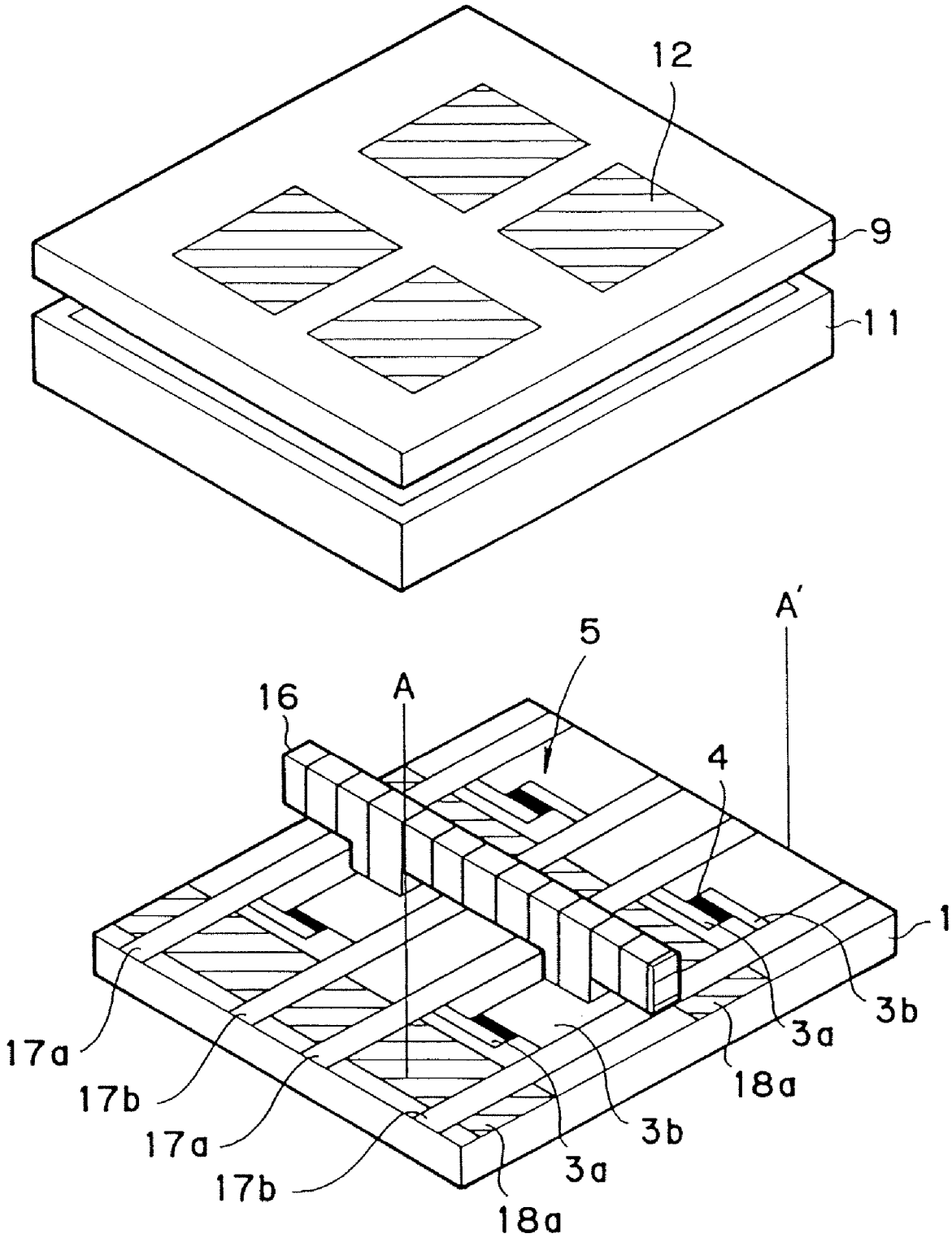
Figure 15:
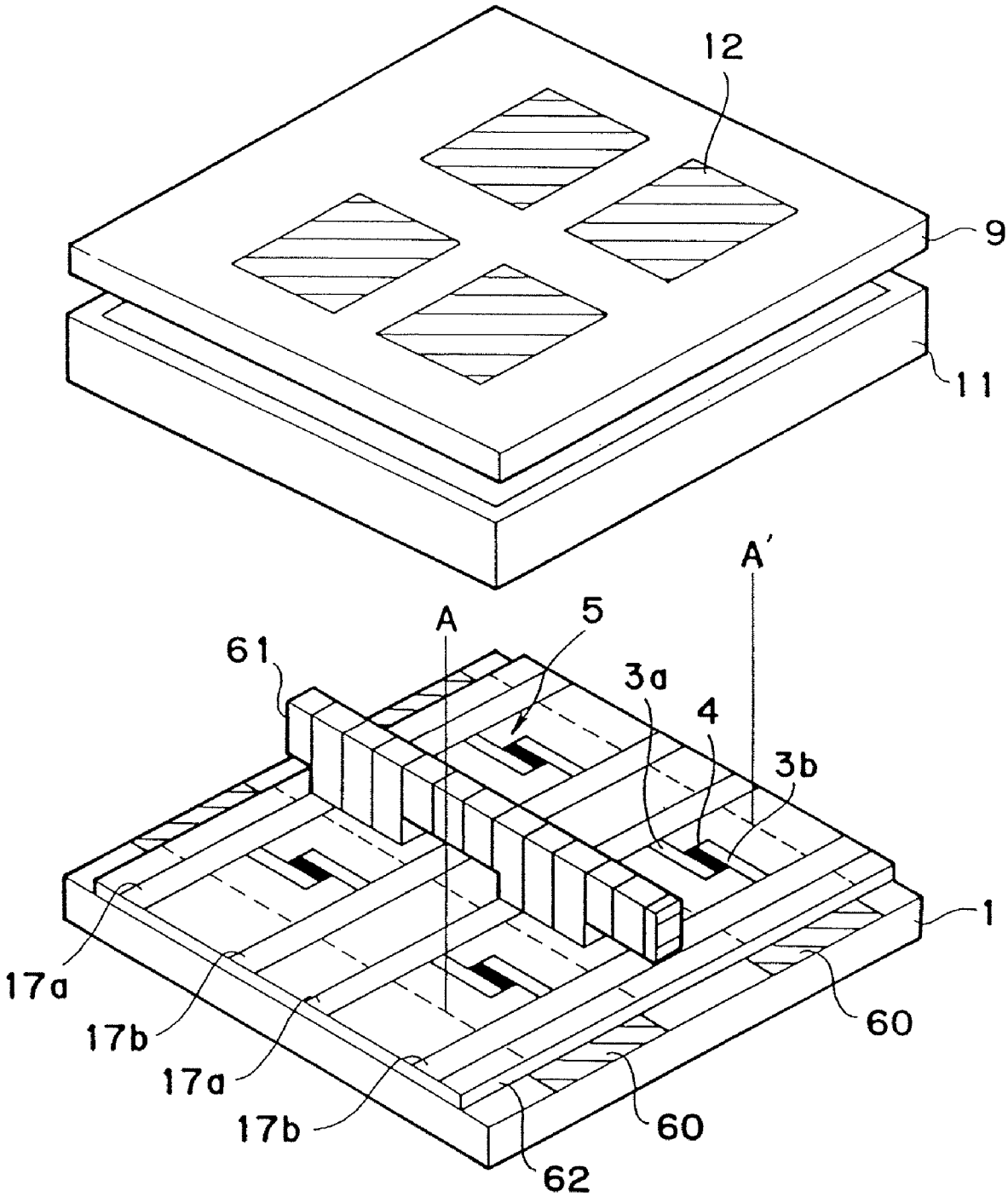

In a case where an electron beam emitted from the electron-emitting element is modulated in accordance with an information signal (control of the quantity of emitted electrons, including on-off control of electron emission), a modulation means is additionally provided. Such a modulation means includes: (I) means in which voltage is applied in accordance with an image information signal to a modulation electrode 18*a* placed on the same plane of the substrate 1 as an electron-emitting element 5 as shown in FIG. 11, or a modulation electrode 60 formed by lamination on an electron-emitting element 5 with interposition of an insulating layer 62 as shown in FIG. 15 to form a desired potential plane in vicinity to the electron-emitting section, thereby controlling the quantity of electron emission; and (II) means in which potential is applied in accordance with image information signals to scanning electrodes 2*a* and information signal electrodes 2*b* arranged in an XY matrix and connected to respective electron-emitting sections 4 arranged also in an XY matrix.

The above constituting members are placed in the envelope. The inside of the envelope is kept at a vacuum degree in a range of from $10^{-5}$ to $10^{-9}$ torr in view of the electron emission characteristics of the electron-emitting elements. The aforementioned supporting member is placed so as to support sufficiently the envelope against the external atmospheric pressure, the shape, the arrangement, and the position being suitably decided.

The image-forming device of the present invention includes the optical printers described below.

Figure 31:
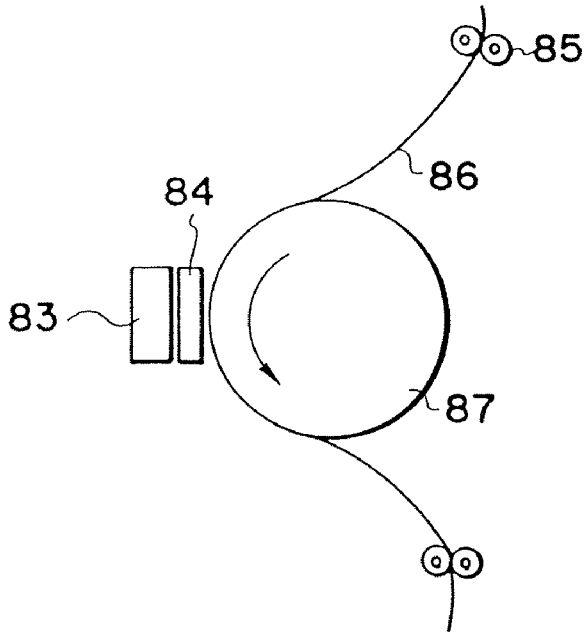
Figure 32:
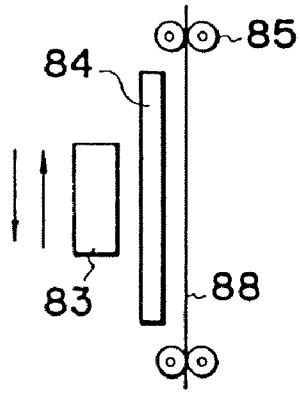
Figure 33:
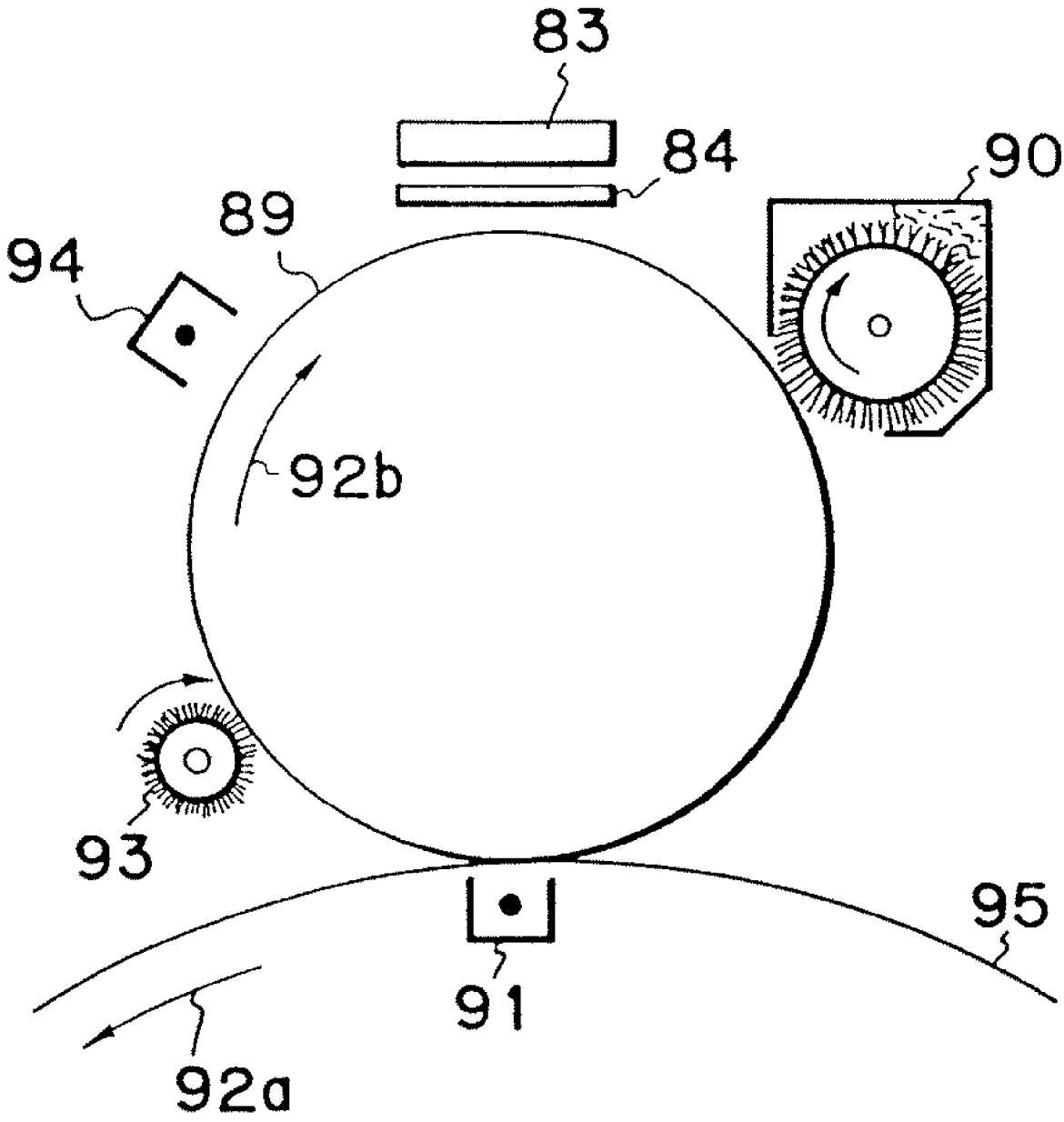

As shown in FIGS. 31 to 33, the optical printer of the present invention employs, as a light source 83, the above image-forming member of the above image-forming device formed by luminescent material. A luminescent pattern is formed in accordance with information signals as described above, and the light beam emitted from the luminescent material in accordance with the luminescent pattern is projected to a recording medium (86, 88, 89) to form an optical pattern if the recording medium is a photosensitive material, or a thermal pattern if the recording medium is a heat-sensitive material. The optical printer has a support (e.g., a drum 87, and a delivering rollers 85) for supporting or delivering the recording medium. The recording medium may be a photosensitive drum 89 as shown in FIG. 33.

The present invention is described specifically and in more detail by reference to Embodiments.

Embodiment 1

FIG. 1 illustrates a rough perspective view of an image-forming device of a first embodiment of the present invention. FIG. 2 is a cross-sectional view of the image-forming device viewed at A-A' in FIG. 1.

In the drawing, a rear plate 1, an external frame 11, and a face plate 9 constitute an envelope. An electron-emitting section 4, and electrodes 3*a* and 3*b* for applying voltage to the electron-emitting section constitute an electron-emitting element 5. Wiring electrodes 2*a* and 2*b* (2*a*: a scanning electrode, and 2*b*: an information signal electrode) are connected respectively to the above electrodes 3*a* and 3*b*. A glass substrate 6, a fluorescent material (image-forming member) 8, and a transparent electrode 7 for applying voltage to the fluorescent material constitute the face plate 9. The numeral 12 denotes a luminescent spot, the numeral 10 denotes an electroconductive supporting member to support the envelope against external atmospheric pressure, and the numeral 13 denotes a power source for applying prescribed voltage to the electroconductive supporting member.

As shown in the drawing, the electron-emitting element 5 and the fluorescent material 8 as the image-forming member are placed respectively on counterposed substrates (a rear plate 1 and a glass plate 6). The electroconductive supporting member 10 is placed between the substrates so as to support the rear plate 1 and the face plate 9 against the atmospheric pressure. As shown in FIG. 2, the supporting member 10 is positioned between the electron-emitting elements 5 on the rear plate side, and is positioned on the face plate side without electrical contact with the fluorescent materials 8 and the transparent electrode 7, so that the potential of the supporting member 10 is decided certainly by the potential applied by the power source 13.

The electron-emitting element 5 is the aforementioned surface conduction type emitting element. A plurality of electron-emitting elements are arranged in an XY matrix. All of the electrodes 3*a* of the electron-emitting elements are connected to the scanning electrodes 2*a*. The electrodes 3*b* are connected to the information signal electrodes 2*b*. Thus the electron-emitting element has a simple matrix construction which emits electrons on application of voltage between the electrodes 2*a* and 2*b* in correspondence with information signals.

The transparent electrode 7 constructing the face plate 9 is connected to an external power source although it is not shown in the drawing. Therefore a prescribed voltage is applied through the transparent electrode 7 to the fluorescent material 8 placed adjacent to the transparent electrode 7. This voltage is usually in the range of from 800 V to 6 kV, but is not limited thereto. In the case where a color image is displayed, the fluorescent material 8 is replaced with three-primary color fluorescent materials of red, green, and blue.

A process for producing an image-forming device of this Embodiment is briefly described below.

(1) An insulating substrate, as a rear plate 1, is sufficiently washed. Thereon electrodes 3*a*, 3*b* are formed according to conventional vapor deposition technique and photolithography technique. Subsequently an information electrodes 2*b* is formed similarly.

(2) For electrical insulation of an information signal electrode 2*b* from a scanning electrode 2*a*, an insulating layer is formed at the site where the electrodes will intersect (not shown in the drawing). Then a scanning electrode 2*a* is provided according to a vapor deposition technique and a patterning technique (including photolithography and etching).

In the above steps (1) and (2), the electrodes are formed with a material mainly composed of nickel, gold, aluminum, or the like to have sufficiently low electric resistance. The insulating layer is formed mainly from $SiO_2$, or the like. In surface conduction type emitting elements, the gap G between the electrodes 3*a* and 3*b* (electrode gap) is preferably in a range of from 0.01 μm to 100 μm, more preferably from 0.1 μm to 10 μm in view of the electron-emitting efficiency. In this Embodiment, the gap is 2 μm, the length L of the electron-emitting section 4 is 300 μm, and the arrangement pitch of the electron-emitting elements 5 is 1.2 mm.

(3) Then an ultrafine Pd particle film having particle diameter of about 100 Å is formed between the opposing electrodes 3*a* and 3*b*. As the material for the ultrafine particle film, suitable are metals such as Ag and Au, and oxides such as $SnO_2$ and $In_2O_3$ in addition to the above-mentioned Pd. In surface conduction type emitting elements, the particle diameter is preferably in a range of from 10 Å to 10 μm especially in view of the electron-emitting efficiency. The ultrafine particle film is adjusted to have a sheet resistance preferably in a range of from $10^3$ Ω/square to $10^9$ Ω/square. The ultrafine particle film having desirable characteristics can be prepared, for example, by applying a dispersion of an organometal and heat-treating the applied organometal to form an ultrafine particle film between the electrodes, instead of gas deposition method mentioned above.

(4) Then, on a glass substrate 6, a transparent electrode 7 is formed with a material of ITO according to conventional technique of vacuum deposition and patterning, and thereon a fluorescent material 8 is laminated, thus completing a face plate 9.

(5) An electroconductive supporting member 10 is placed as shown in FIG. 2. The electroconductive supporting member employed here is prepared by working photosensitive glass 10*a* and providing an electroconductive film 10*b* on the surface thereof. The electroconductive support has a thickness $T_2$ of 150 μm, a height $T_1$ of 1500 μm.

(6) An external frame 11 of 1.5 mm thick is placed between rear plate 1 and the face plate 9. Then frit glass is applied between the face plate 9 and the external frame 2, and also between the rear plate 1 and the external frame 2. The applied matter is fired at 410° C. for 10 minutes or longer to bond them. The electroconductive supporting member 10 is placed in a direction perpendicular to the rear plate 1 so as to serve an atmospheric pressure-supporting column.

(7) The atmosphere in the envelope thus prepared is evacuated by a vacuum pump to a vacuum degree of $10^{-6}$ to $10^{-7}$ torr. It is subjected to a forming treatment, and then the envelope is sealed.

The driving procedure of the image-forming device of this Embodiment is explained below.

Firstly, an electron-emitting voltage of 14 V is applied to a desired one line of the scanning electrodes out of the plurality of scanning electrodes 2*a*, and a voltage of a half of the electron-emitting voltage (namely 7 V) is applied to other lines. Simultaneously, a voltage of 0 V is applied to an information electrode 2*b* connected to an element to emit electrons in accordance with an image information signal for one line, and a voltage of a half of the electron-emitting voltage (namely 7 V) is applied respectively to the information signal electrodes 2*b* connected to other electron-emitting elements. Such a procedure is conducted sequentially with the adjacent scanning electrodes 2*a* to emit electrons for one image, thus obtaining a luminescent image of a fluorescent material 8. The electroconductive supporting member 10 is kept preliminarily by the power source 13 at a potential not exceeding 14 V which is the maximum potential applied to the electron-emitting elements.

With the image-forming device of this Embodiment, an extremely stable luminescent image was formed without irregularity and time-variation of the luminance. Moreover, no discharge occurred which gives fatal damage to the electron-emitting elements during the drive of the device. A long life of image display is practicable. The fluorescent material may be set at a voltage of 1 kV or higher. Color image display was practicable by replacing the fluorescent material 8 in the device with three primary color fluorescent materials.

Embodiment 2

Figure 10:
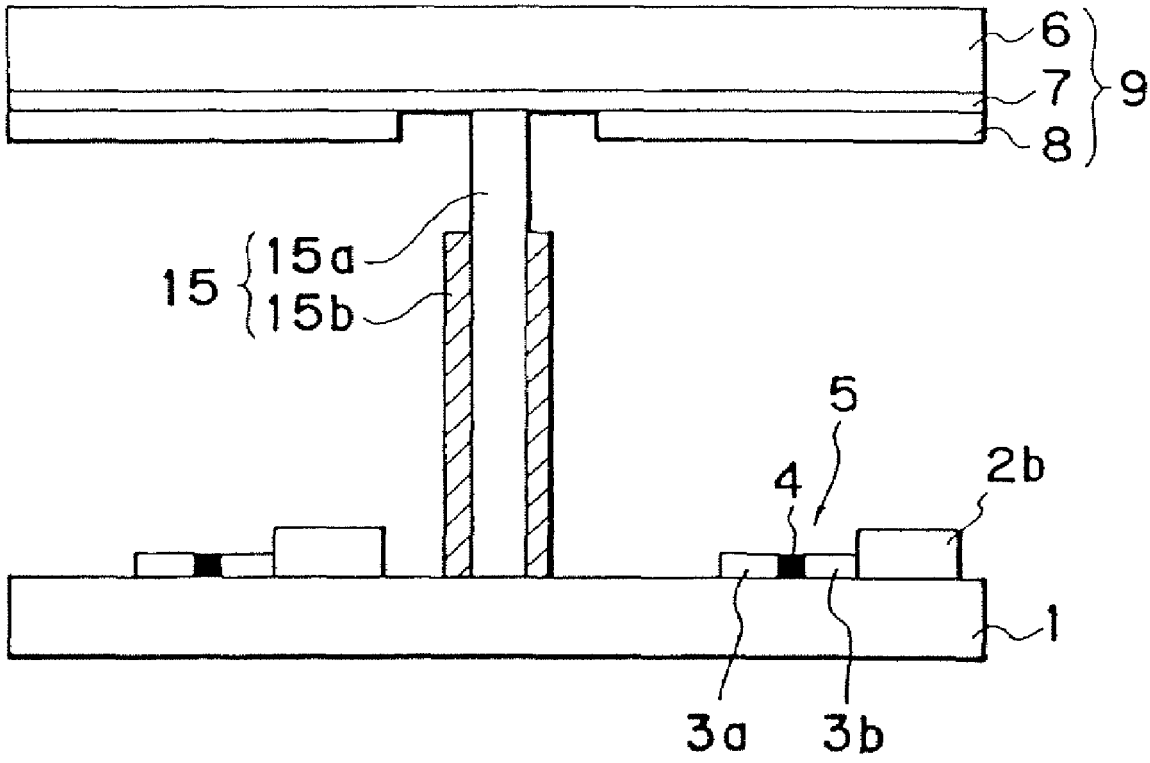

An image-forming device is prepared in the same manner as in Embodiment 1 except that the construction of the electroconductive supporting member 10 of Embodiment 1 is changed as shown in FIG. 10 (sectional view). That is, the electroconductive supporting member 15 of this Embodiment is formed such that the electroconductivity-imparting region (electroconductive film 15*b*) covers the supporting member only in the vicinity of the electron-emitting element 5, and the electroconductive film 15*b* does not cover the area of the supporting member in the vicinity of the fluorescent material 8.

The same effect as in Embodiment 1 was confirmed in this Embodiment also. Since the area near the fluorescent material 8 of the electroconductive supporting member 15 is insulated (photosensitive glass 15*a*), the voltage of the fluorescent material given by the transparent electrode 7 can be made higher than that in Embodiment 1. Therefore, much higher luminance of image display could be achieved, and color image could be obtained more readily.

Embodiment 3

Figure 12:
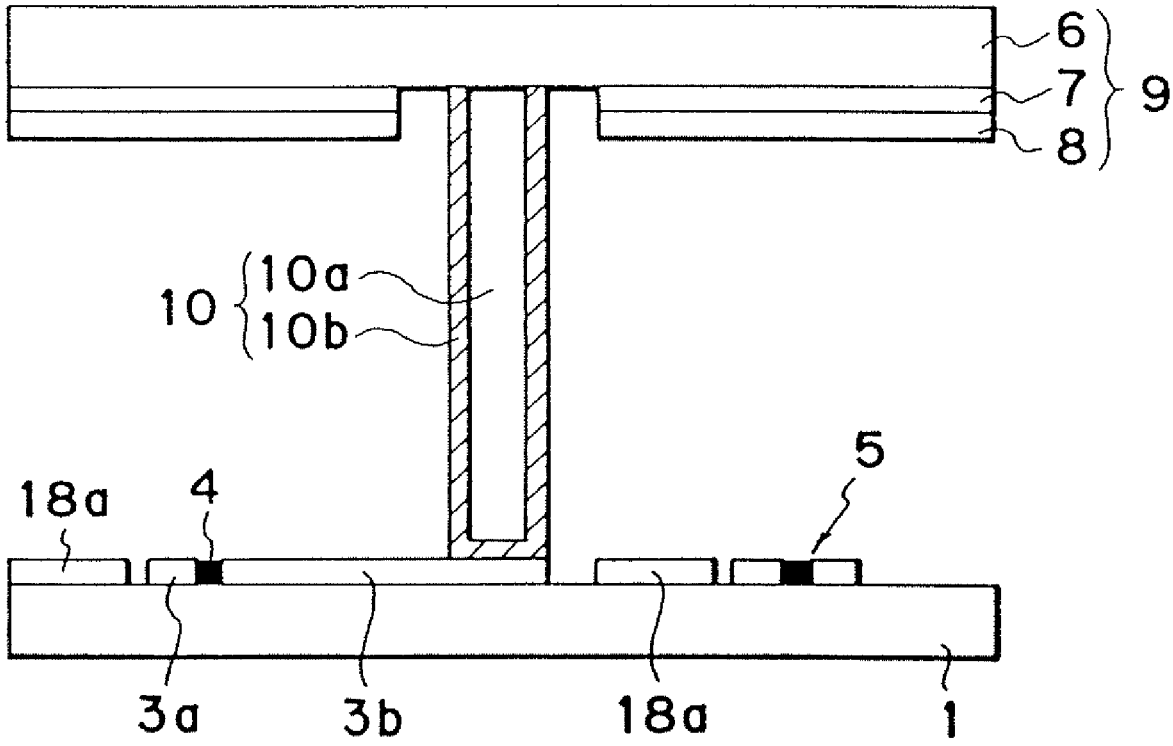

FIG. 11 is a rough perspective view of the image-forming device of this Embodiment. FIG. 12 is a cross-sectional view at A-A' in FIG. 11.

In FIG. 11 and FIG. 12, wiring electrodes 17*a* and 17*b* of the electron-emitting element are connected respectively to the electrodes 3*a* and 3*b*. A plurality of electron-emitting elements 5 (surface conduction type emitting elements) are arranged between the wiring electrodes 17*a* and 17*b*. On the rear plate 1, electron sources are formed in lines. Modulation electrodes 18*a*, which control ON/OFF of electron beams emitted by the electron-emitting elements, are arranged in an XY matrix relative to the lines of the electron source. The wiring electrodes 17*a* and 17*b* are insulated from the modulation electrodes 18*a*, which is not shown in the drawing. Electroconductive supporting member 16 is arranged on the electrode 3*b*, and is connected electrically to the electrode 3*b* so that the both are at the same potential. The image-forming device of this Embodiment is prepared approximately in the same manner as in Embodiment 1.

The procedure of driving the image-forming device of this Embodiment is described below.

A voltage of 0.8 to 6.0 kV is applied to the fluorescent material 8 through the transparent electrode 7. A voltage is applied to the desired electron sources in lines by applying a voltage of 0 V to the wiring electrodes 17*a* and a voltage of 14 V to the wiring electrodes 17*b*. Simultaneously, a prescribed voltage is applied to a plurality of modulation electrodes 18*a* in correspondence with information signals, whereby electron beams are emitted from desired electron-emitting elements according to the information signal. The potential of the electroconductive supporting member 16 is controlled not to exceed 14 V, namely the maximum potential applied to the electron-emitting elements 5 through the wiring electrodes 17*b* and the electrodes 3*b*. The modulation electrodes can control the electron beam to be in an off state by application of a voltage of −50 V or lower, and control it to be in an on state by application of a voltage of 20 V or higher. The quantity of the electron of the electron beam can be continuously varied in a range of the voltage from −60 V to 40 V, and tone displaying is practicable.

Such procedure is sequentially conducted for adjacent electron sources in lines to emit electrons for one picture to obtain a luminescent image on the fluorescent material.

With the image-forming device of this Embodiment, similarly in Embodiment 1, an extremely stable luminescent image was formed without irregularity and time variation of the luminance. Moreover, no discharge occurred which gives fatal damage to the electron-emitting elements during the drive of the device, whereby a long life of image display is practicable. The fluorescent material may be set at a voltage of 1 kV or higher. Color image display is practicable by replacing the fluorescent material 12 in the device with a three primary color fluorescent material. Furthermore, the image-forming device of this Embodiment can be made simple at low cost in comparison with the one of Embodiment 1, because no separate power source is required for controlling the potential of the electroconductive supporting member 18.

Embodiment 4

The image-forming device of Embodiment 4 was driven in the same manner as in Embodiment 3 except that the voltages of the wiring electrodes 17*b* and 17*a* are respectively 0 V, and 14 V. Therefore, in this Embodiment, the potential of the electroconductive supporting member 16 is kept at 0 V through the wiring electrode 17*b* and the electrode 3*b* (low potential electrode).

With the image-forming device of this Embodiment, the effect is almost the same as in Embodiment 3. Furthermore, even when the voltage applied to the modulation electrode 18*a* is set lower as a whole in comparison with Embodiment 3, nearly the same quality of image could be displayed.

Embodiment 5

Figure 13:
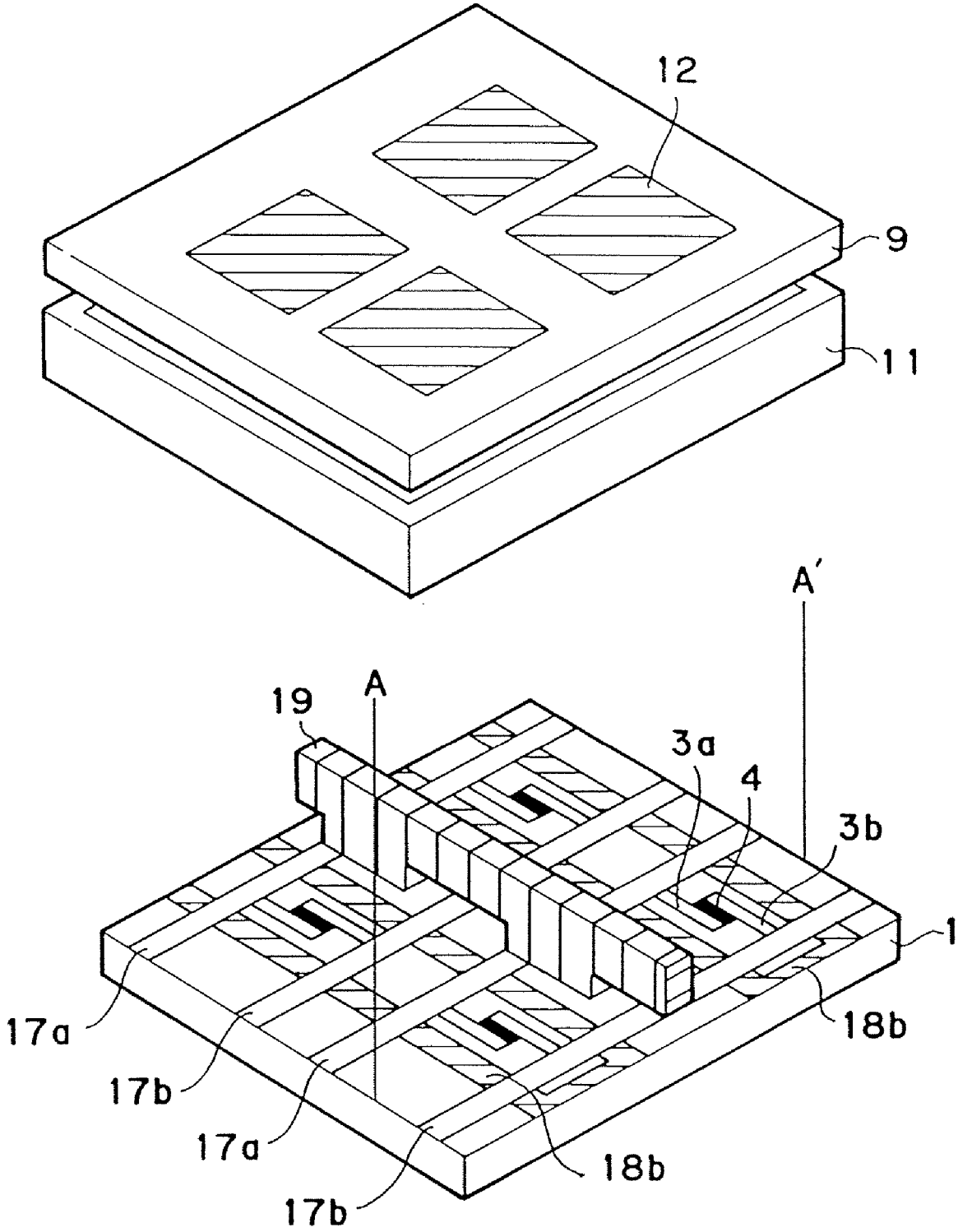
Figure 14:
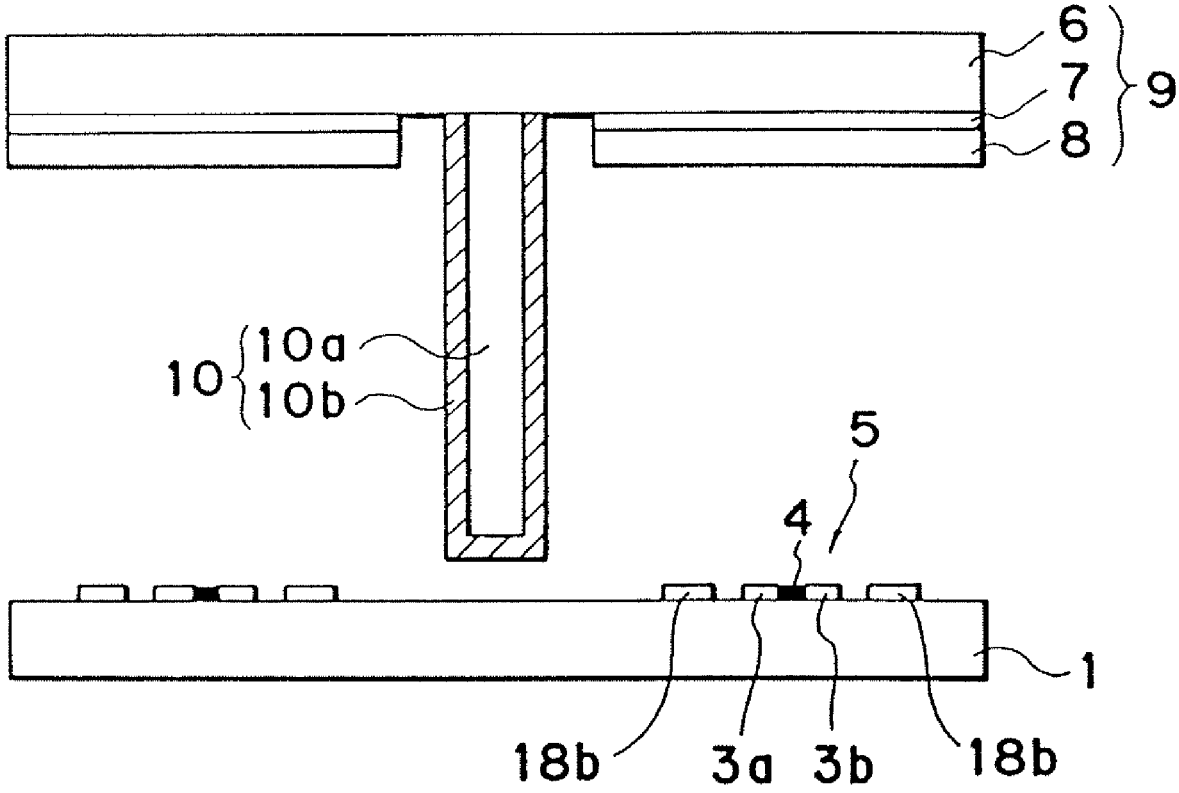

FIG. 13 is a rough perspective view of the image-forming device of this Embodiment. FIG. 14 is a cross-section thereof viewed at A-A' in FIG. 13. The numeral 18*b* denotes a modulation electrode, and the numeral 19 denotes an electroconductive supporting member.

The image-forming device of this Embodiment has the same construction as that of Embodiment 3, except that the modulation electrode 18*a* of Embodiment 3 is placed so as to surround both sides of the electron-emitting element as indicated by the numeral 18*b* in FIG. 13, and the electroconductive supporting member of Embodiment 3 is electrically connected with the wiring electrode 17*a* as indicated by the numeral 19 in FIG. 13 so that the surface of the electroconductive supporting member may be at the same potential as that of the wiring electrodes 17*a*.

The image-forming device of this Embodiment is driven in the same manner as that of Embodiment 3. In this Embodiment, the potential of the electroconductive member 19 is controlled through the wiring electrode 17*a* to be 14 V, which is the maximum potential applied to the electron-emitting element 5.

With the image-forming device of this Embodiment, similarly in Embodiment 3, an extremely stable luminescent image was formed without irregularity and time-variation of the luminance. Moreover, no discharge occurred which gives fatal damage to the electron-emitting elements during the drive of the device, whereby a long life of image display is practicable. The fluorescent material may be set at a voltage of 1 kV or higher. Color image display is practicable by replacing the fluorescent material 9 in the device with three primary color fluorescent materials. Furthermore, even when the voltage applied to the modulation electrode 18*b* is set lower as a whole than Embodiment 3, nearly the same quality of image could be displayed.

Embodiment 6

The image-forming device of Embodiment 6 is driven in the same manner as in Embodiment 5 except that the voltage of the wiring electrodes 17*b* is 14 V, and the voltage of the wiring electrode 17*a* is a 0 V. Therefore, in this Embodiment, the potential of the electroconductive supporting member 19 is kept at 0 V through the wiring electrode 17*a* (low potential electrode).

With the image-forming device of this Embodiment, the effect was almost the same as in Embodiment 5. Furthermore, the displayed image was more uniform than that in Embodiment 5.

Embodiment 7

Figure 16:
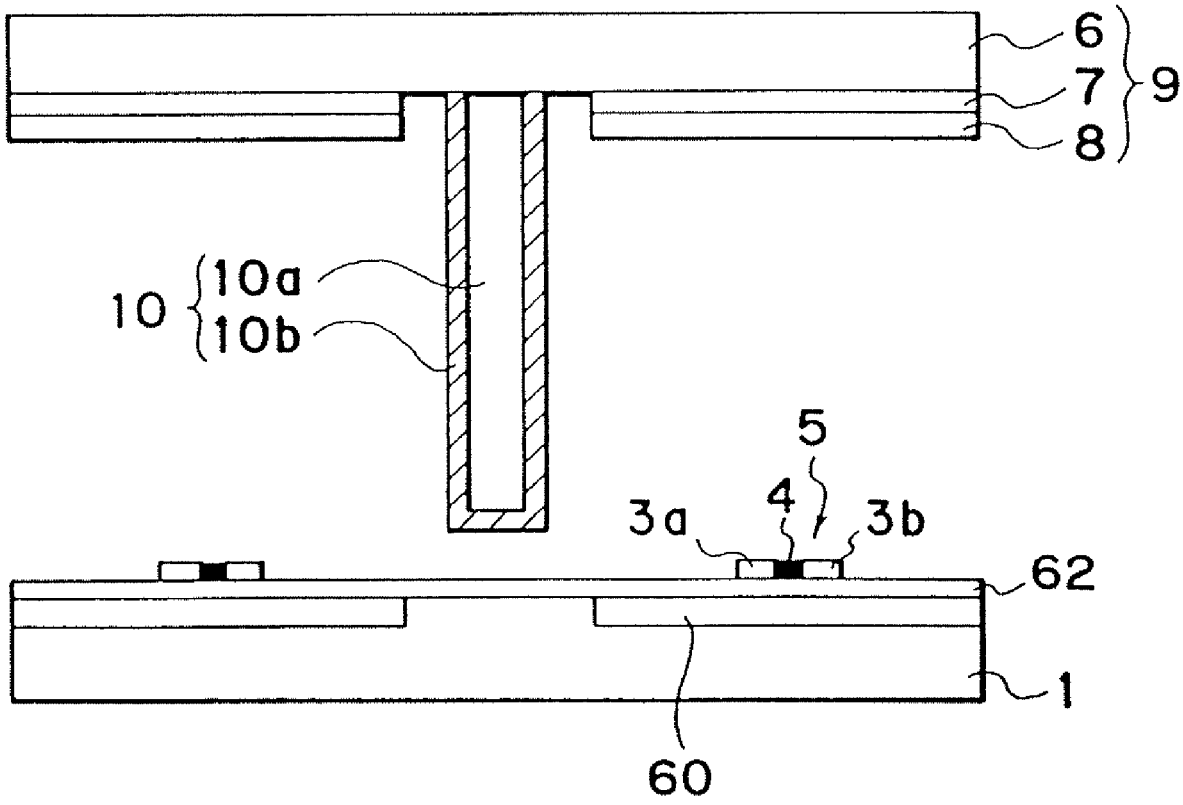

FIG. 15 is a rough perspective view of the image-forming device of this Embodiment. FIG. 16 is a cross-sectional view thereof at A-A' in FIG. 15. The numeral 60 denotes modulation electrodes, the numeral 62 denotes an insulating layer, and the numeral 61 denotes an electroconductive supporting member.

The image-forming device of this Embodiment has the same construction as that of Embodiment 5, except that the modulation electrode 60 is provided under the electron-emitting element 5 with interposition of an insulating layer 62. The image-forming device of this Embodiment is driven in the same manner as that of Embodiment 5. In this Embodiment, the potential of the electroconductive member 61 is controlled through the wiring electrode 17*a* to be at 14 V, which is the maximum potential applied to the electron-emitting element 5.

With the image-forming device of this Embodiment, similarly in Embodiment 5, an extremely stable luminescent image was formed without irregularity and time variation of the luminance. Moreover, no discharge occurred which gives fatal damage to the electron-emitting elements during the drive of the device, whereby a long life of image display is practicable. The fluorescent material may be set at a voltage of 1 kV or higher. Color image display is practicable by replacing the fluorescent material 8 in the device with three primary color fluorescent materials.

Embodiment 8

The image-forming device of Embodiment 7 was driven in the same manner as in Embodiment 7 except that the voltage of the wiring electrodes 17*b* is 14 V, and the voltage of the wiring electrode 17*a* is 0 V. Therefore, in this Embodiment, the potential of the electroconductive supporting member 61 was kept at 0 V through the wiring electrode 17*a* (low potential electrode).

With the image-forming device of this Embodiment, the effect is almost the same as in Embodiment 7. Furthermore, the displayed image is more uniform than that in Embodiment 7.

Embodiment 9

Figure 18:
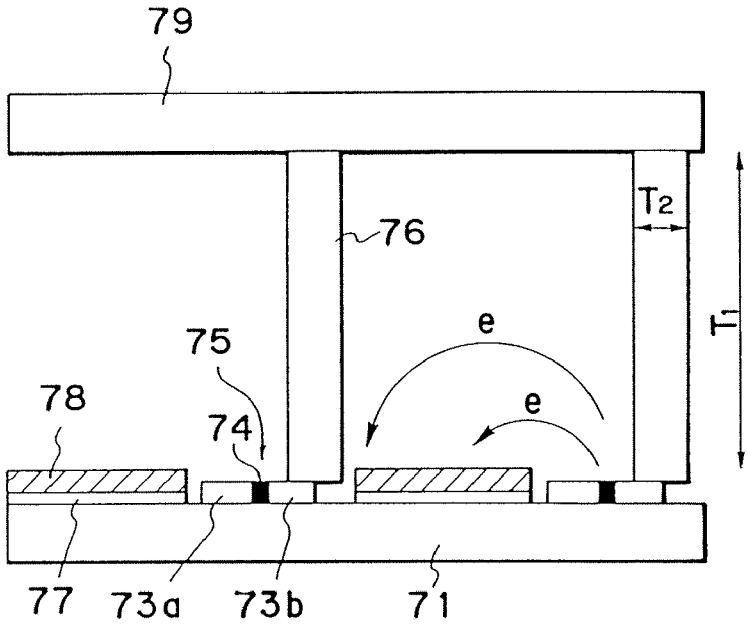
Figure 19:
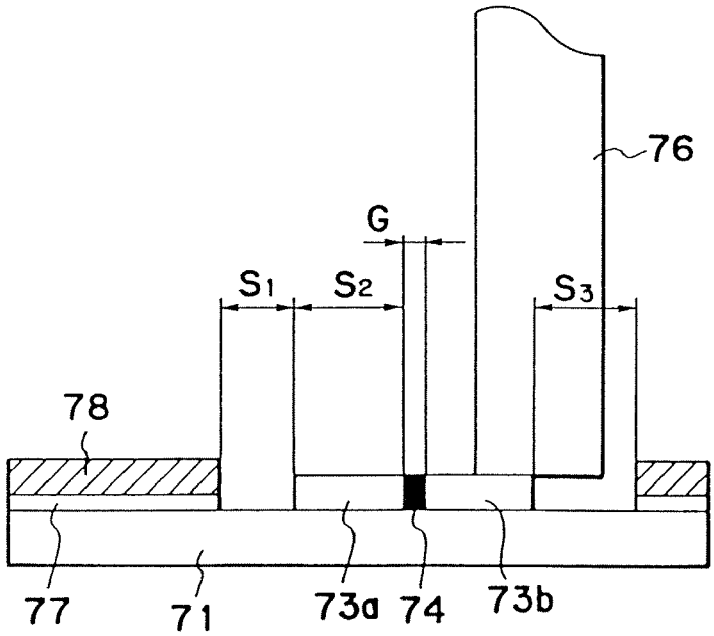

FIG. 17 is a perspective view of an image-forming device of a ninth embodiment. FIG. 18 is a sectional view of the device illustrated in FIG. 17. FIG. 19 is a sectional view of one electron emitting section of the device. In this device, as shown in the drawings, an electron-emitting element 75 emits electrons by application of voltage between opposing electrodes of a positive (high potential) electrode 73*a* and a negative (low potential) electrode 73*b*. An image-forming member 78 forms images by irradiation of an electron beam emitted by the electron-emitting element 75. The electron-emitting element 75 and the image-forming member 78 are provided in juxtaposition on the same insulating substrate 71. The insulating substrate 71, supporting frame 80, and face plate 79 constitute a vacuum vessel (or an envelope). An electroconductive member wall (or an atmospheric pressure-supporting member) 76 is placed such that at least a portion of the end thereof is situated on a part of the negative electrode 73*b*.

The electroconductive member wall 76 is connected electrically with the negative electrode 73*b*, and is at the same potential with that of the negative electrode 73*b*.

A plurality of the electron-emitting elements are arranged in lines. In each line, the positive electrodes 73*a* and the negative electrodes 73*b* are connected respectively by element-wiring electrodes 72*a* and 72*b*. The electron-emitting elements 75 connected by the same element-wiring electrodes 72*a* and 72*b* constitute one electron-emitting element line which is driven simultaneously.

The image-forming members 78 are constituted by a fluorescent material, and are provided corresponding to respective electron-emitting elements, and form electron-emitting element lines, each line being connected in a direction perpendicular to the above electron-emitting element lines. The connection in the lines is made by image-forming member wiring electrode 77, through which voltage is applied to each image-forming member 78. Between the image-forming member wiring electrodes 77 and the element-wiring electrodes 72*a* and 72*b*, an insulation film is provided to secure electrical insulation. For obtaining a color image, image-forming members 78 made of fluorescent material of R (red), G (green), and B (blue) are sequentially provided.

The electron-emitting element 75 is of a surface conduction type cold cathode, and has electron-emitting section 74 between the positive and negative electrodes 73*a* and 73*b*. From the electron-emitting section, electrons are emitted on application of voltage between the electrodes.

The face plate 79 is transparent, and is supported by an external frame 80 to confront the insulating substance 71. The face plate 79, an insulating substrate 71, and the external frame 80 constitute a panel vessel (or an envelope). The pressure in the vessel is kept at $10^{-5}$ to $10^{-7}$ torr in view of electric characteristics of the electron-emitting elements.

A process for producing the device is described below.

An insulating substrate 71 is sufficiently washed. Thereon, element electrodes 73*a* and 73*b* and image-forming member wiring electrode 77 are prepared from a material mainly composed of nickel according to conventional techniques of deposition and photolithography. Any material may be used if the electrode is made to have sufficiently low electric resistance.

An insulating layer is formed between image-forming member wiring electrodes 77 and element-wiring electrodes 72*a* and 72*b* and at the position corresponding to the element-wiring electrodes 72*a* and 72*b* on the image-forming member wiring electrodes 77 for electric insulation according to a film forming technique for thin film and thick film formation. The insulating layer consists of $SiO_2$. In this Embodiment, the thickness of the insulation film is 5 μm.

Then element-wiring electrodes 72*a* and 72*b* are prepared from a material mainly composed of Ni according to vapor deposition and etching such that the element electrodes 73*a* and 73*b* form an opposing electron-emitting section 74. In surface conduction type emitting elements, the electrode gap G (see FIG. 19) between the element electrodes 73*a* and 73*b* is preferably in a range of from 0.01 μm to 100 μm, more preferably 0.1 μm to 10 μm. In this Embodiment, the gap is 2 μm. The length L (see FIG. 17) of the portion corresponding to the electron-emitting section 74 is 300 μm. The width $S_2$ (see FIG. 19) of the element electrodes 73*a* and 73*b* are desired to be narrower, but are practically in a range of from 1 μm to 100 μm, preferably 1 μm to 50 μm. In this Embodiment (see FIG. 19), the distance $S_1$ between the element electrodes 73*a* and the adjacent image-forming member 78 is 80 μm; the breadth $S_2$ of the element electrodes 73*a* and 73*b* is 50 μm; the distance $S_3$ between the element electrode 73*b* and the adjacent image-forming member 78 is 200 μm. The arrangement pitch of the element-wiring electrodes 72*a* and 72*b* is 1 mm, and the arrangement pitch of the electron-emitting section 74 is 1 mm.

As the electron-emitting section 74, an ultrafine particle film is formed between the opposing electrodes with Pd as the material by gas deposition. Other preferred materials include metals such as Ag and Au, and oxides such as $SnO_2$ and $In_2O_3$, but are not limited thereto. In surface conduction type emitting elements, the diameter of the ultrafine particles is preferably in a range of from 10 Å to 10 μm particularly in view of electron emission efficiency, and the sheet resistance of the ultrafine particle film is preferably in a range of from $10^3$ Ω/square to $10^9$ Ω/square. In this Embodiment, the diameter of the Pd particles is about 100 Å. No by the gas deposition method mentioned above, desired characteristics of the ultrafine particle film can be prepared, for example, by applying a dispersion of an organometal and heat-treating the applied organometal to form an ultrafine particle film between the electrodes.

An image-forming member 78 mainly composed of a fluorescent material is prepared in a thickness of about 10 μm by a printing method. It may be formed by another method such as a slurry method, and a precipitation method.

An electroconductive member wall 76 is placed on the negative element electrode 73*b*. The atmospheric pressure-supporting member 76 is constituted of an electroconductive material. In this Embodiment, it is made by working ordinary photosensitive glass and providing an electrode over the entire surface thereof. However, the member is not limited thereto, but may be made of a metal fabricated in a prescribed dimension. The electroconductive member wall 76 is formed to have a thickness $T_2$ of 150 μm, and a height $T_1$ of 1200 μm (see FIG. 18).

Between the insulating substrate 71 having the electron-emitting elements thereon and a face plate 79, an external frame 80 of about 1.2 mm thick is placed. The interstices thereof are bonded by applying frit glass and firing it at 430° C. for 10 minute or longer. The electroconductive member 76 is placed perpendicularly to the insulating substrate 71 to serve an atmospheric pressure-supporting column between the insulating substrate 71 and the face plate 79.

The glass vessel completed thus is evacuated with a vacuum pump to attain a sufficient vacuum degree, then subjected to a forming treatment, and is sealed. The vacuum degree is $10^{-6}$ to $10^{-7}$ torr to obtain a stable performance.

The operation of the device is explained below.

With the above construction, when a voltage pulse is applied to a certain electron-emitting element line, 0 V to an element-wiring electrode 72*b* and 14 V to a corresponding element-wiring electrode 72*a*, then electrons are emitted from the electron-emitting elements 75 connected thereto. Simultaneously, the voltage of 0 V is applied to the electroconductive supporting member 76 through the negative element electrode 73*b*, and a voltage corresponding to information signal for the electron-emitting element line is applied to the image-forming member 78 through the image-forming member wiring electrode 77.

The electron beam emitted from an electron-emitting element 75 is deflected toward the positive electrode 73*a*, and is turned on or off by the voltage applied to the image-forming member 78 adjacent to the positive electrode 73*a*. If a positive high voltage is applied to the corresponding image-forming member 78, the electron beam is attracted by the image-forming member 78 and collides against it to cause luminescence of the luminescent material thereon, namely it being in an on state. If a relatively low positive voltage is applied to the image-forming member 78, the image-forming member does not emit light, and in an off state. The voltage applied to the image-forming member 78 is in a range of from 10 to 1000 V, but depends on the kind of the employed fluorescent material and require luminance, and is not limited to the above range. In such a manner, one line of information signals are displayed by the image-forming member 78 corresponding to the electron-emitting element line.

Subsequently, the pulse voltage of 14 V is applied between the element-wiring electrodes 72*b* and 72*a* in the adjacent line of electron-emitting elements, and the information of the one line is displayed. This step is sequentially conducted to form one face of a picture image. Briefly, an picture image is displayed by utilizing the group of element-wiring electrodes as the scanning electrodes and image-forming member lines in an XY matrix.

Figure 20:
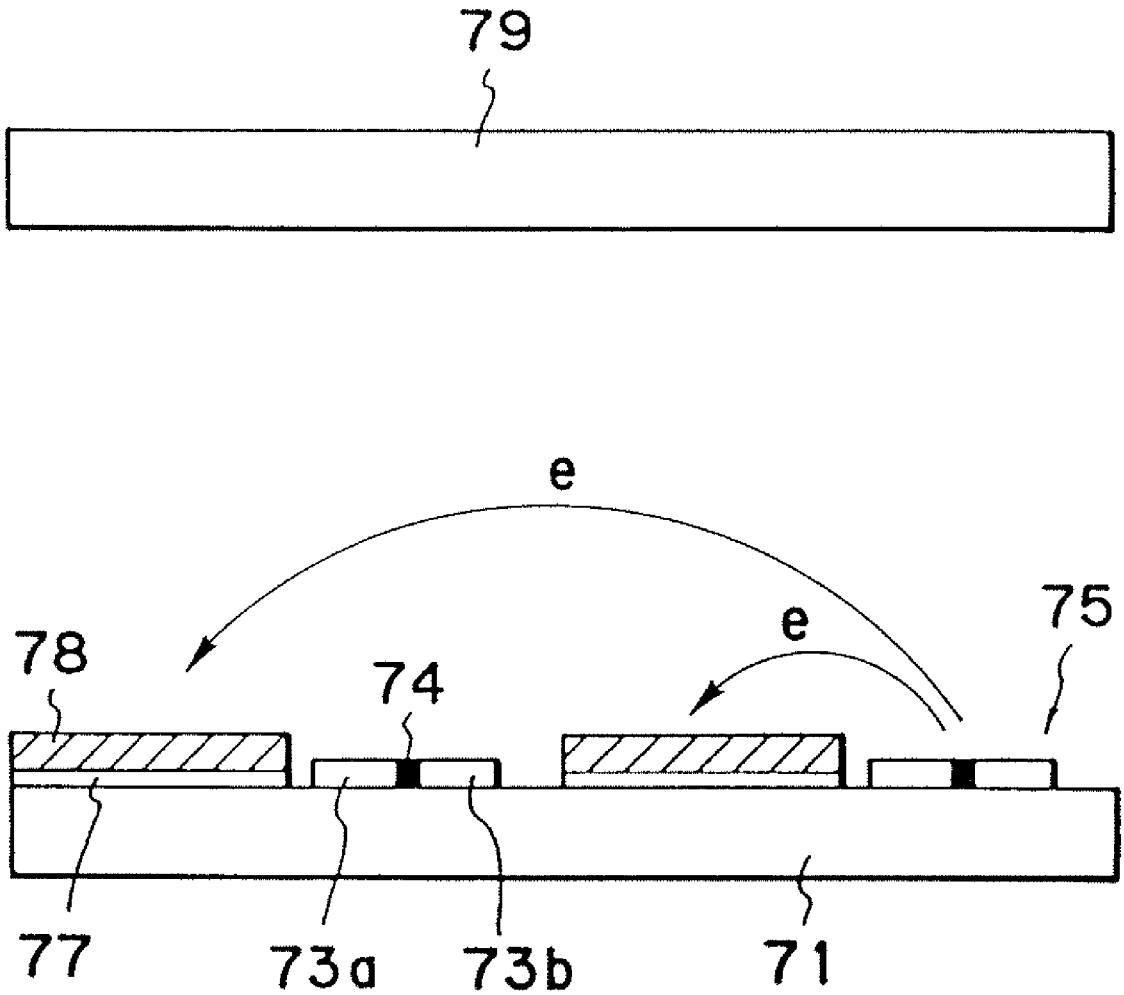
FIGS. 20 and 26 are drawings for explaining locus of an emitted electron.

In the case where image is made extremely fine or a high voltage is applied to the image-forming member 78 as in this Embodiment, if the electroconductive member wall 76 is not provided, the electron beam e emitted from the electron-emitting element 75 can collide against two image-forming members 78 for two image elements and cause crosstalk as shown in FIG. 20, even if the construction is the same except for the absence of the electroconductive wall element. On the contrary, in this Embodiment, crosstalk does not occur since the electroconductive supporting member 76 is provided at each interval of the image elements. Furthermore, the electroconductive supporting member 76 is connected to the negative element electrode 73*b*, whereby, the electron beam e emitted from the electron-emitting element 75 collides effectively against the image-forming member 78 to give an image of high resolution.

According to this Embodiment, with surface conduction type emitting elements which can be driven in response to a voltage pulse of 100 picoseconds or less, 10,000 or more scanning line can be formed for 1/30 second of one image display.

In this Embodiment, uniform image display is realized for a long time without irregularity of luminance caused by damage of the electron-emitting element 75 caused by ion impact, since the electron-emitting element 75 and the image-forming member 78 are formed on the same substrate 71, and the electron beam is made to collide against the image-forming member 78 under the voltage applied thereto. With a surface conduction type electron-emitting element, in which electrons are emitted into a vacuum space at an initial velocity of several electron volts, modulation can be highly effectively conducted according to the present invention.

In the production of the device, alignment of the electron-emitting element 75 with the image-forming member 78 is easily conducted according to a thin-film forming technique, which enables the production of a large image area display with high resolution at low cost. Further, the gap between the electron-emitting section 74 and the image-forming portion 78 can be made precise, so that an image-display device can be obtained without irregularity of luminance with extremely high uniformity of the image.

The face plate 79 and the insulating substrate 71 are pressed by the atmospheric pressure as the envelope is evacuated. This atmospheric pressure is supported by the electroconductive supporting member 76 between the face plate 79 and the insulating substrate 71. Accordingly, the face plate 79 and the insulating substrate 71 can be constructed from thinner materials, which enables a lighter weight of the device and a larger image area.

Embodiment 10

Figure 21:
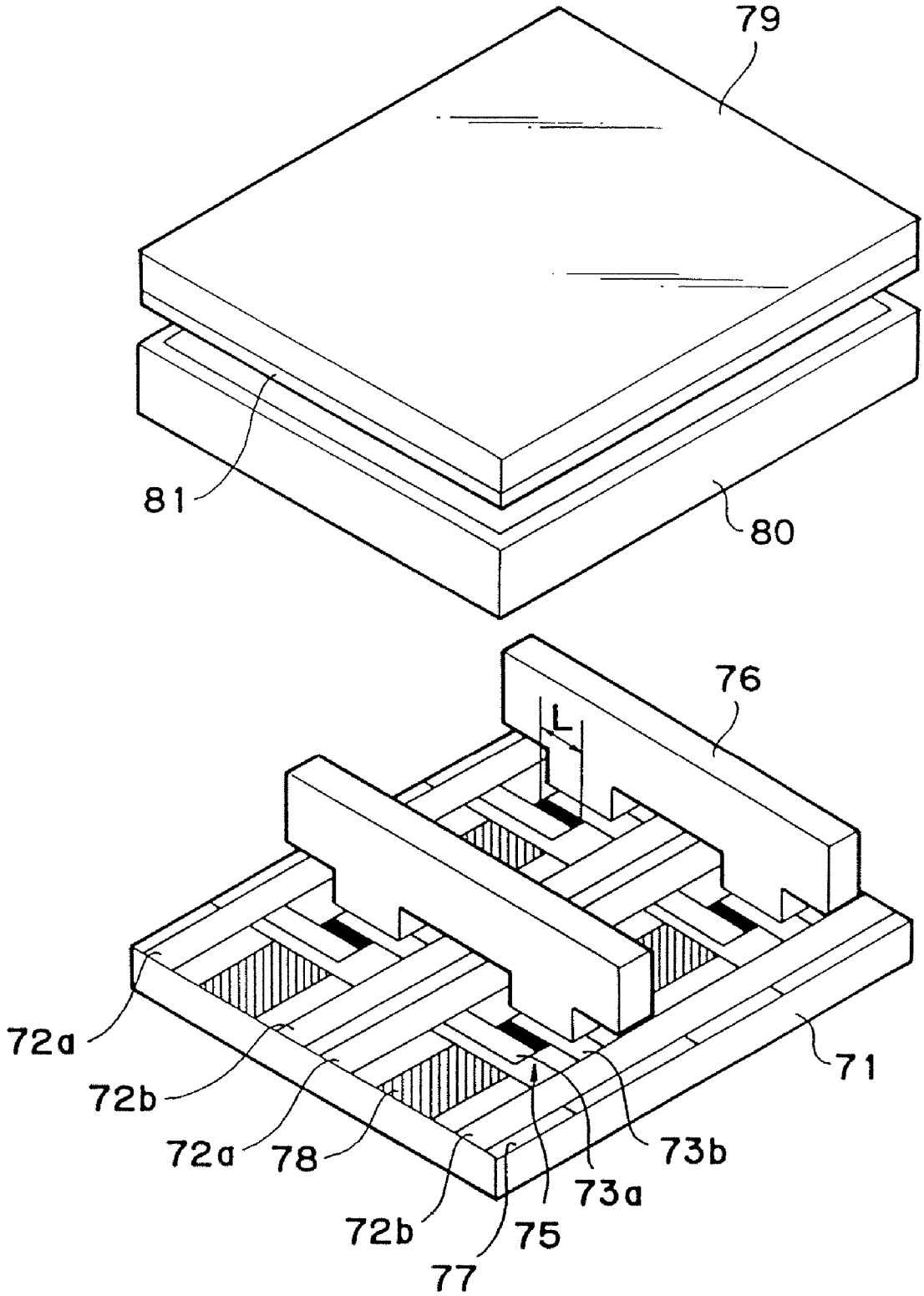
Figure 22:
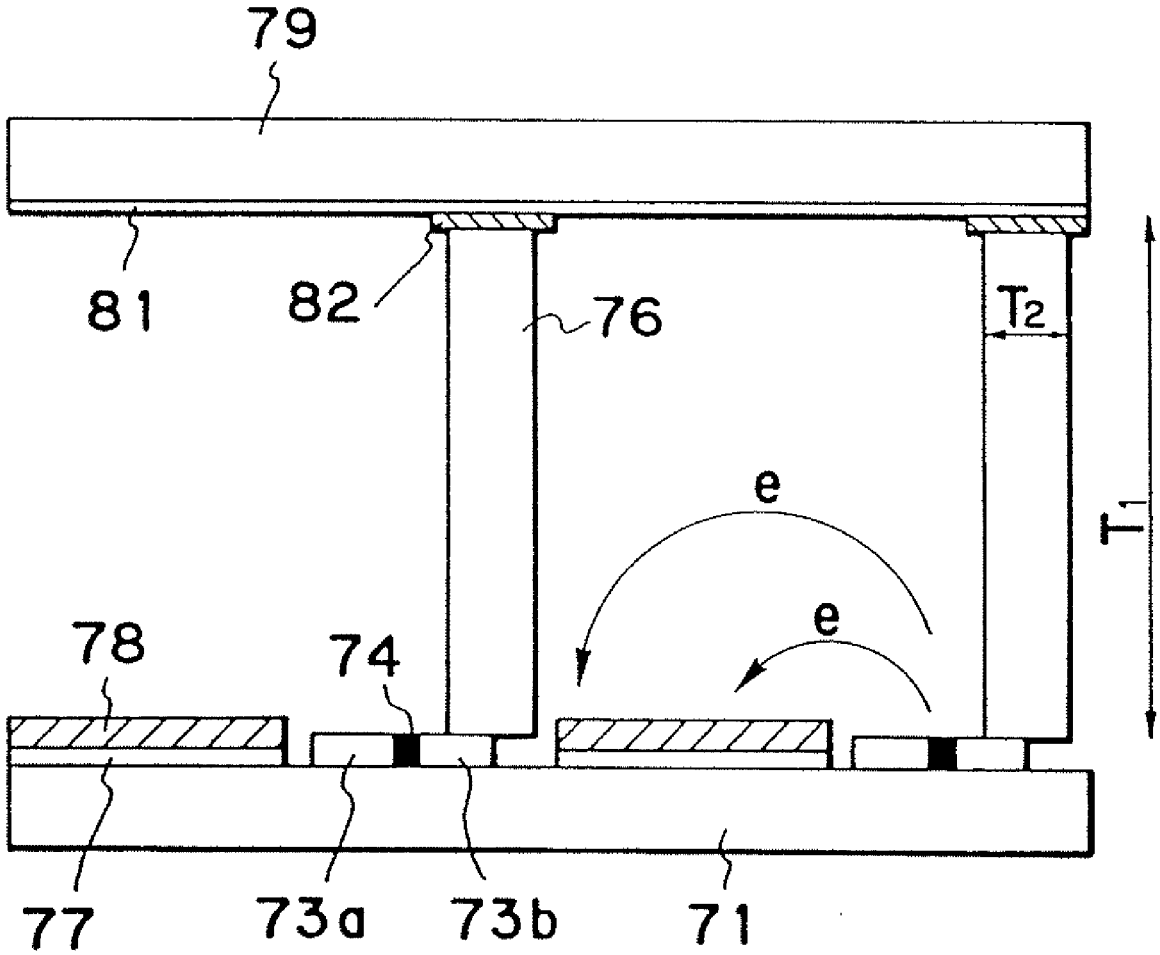

FIG. 21 is a perspective view of the image-forming device of this embodiment. FIG. 22 is a sectional view of the device illustrated in FIG. 21. This device is made by modifying the device of Embodiment 9 by providing a transparent electrode 81 on the face plate 79 opposing the substrate 71, and providing an insulator 82 between the electro-conductive supporting member 76 and the transparent electrode 81. A power source for applying voltage to the transparent electrode 81 is provided although it is not shown in the drawing. The transparent electrode 81 is made of an ITO (indium tin oxide) film, but is not limited thereto. The insulator 82 insulates electrically the transparent electrode 81 from the electroconductive member wall 76, and is preferably in a size nearly equal to the breadth $T_2$ of the electroconductive member wall 76. Otherwise, the device has the same construction, and prepared in the same manner as in Embodiment 9.

The voltage applied to the transparent electrode 81 is preferably decided so that the electron beam emitted from the electron-emitting element 75 may collide against the image-forming-member uniformly. The voltage depends on the voltage applied to the electron-emitting element 75 and the image-forming member 78, and the structure of the electron-emitting element 75, generally being selected in a range of from 0 V to the voltage applied to the image-forming member 78.

This device was evaluated by driving it in the same manner as in Embodiment 9. As the results, the same effect as in Embodiment 9 was achieved, and further, finer and higher quality of image display could be obtained because of more uniform collision of electrons on the image-forming member 78.

Embodiment 11

Figure 23:
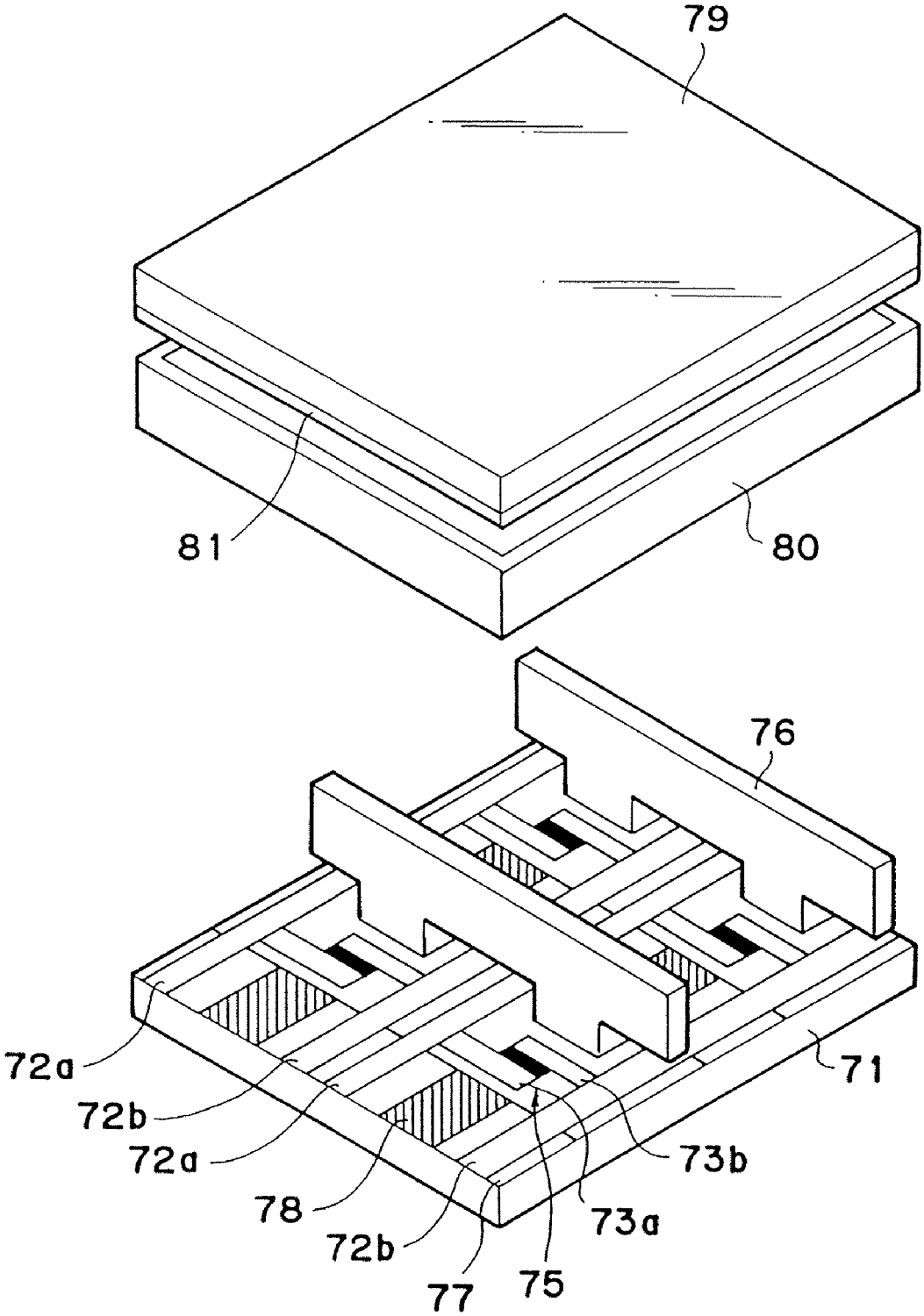
Figure 24:
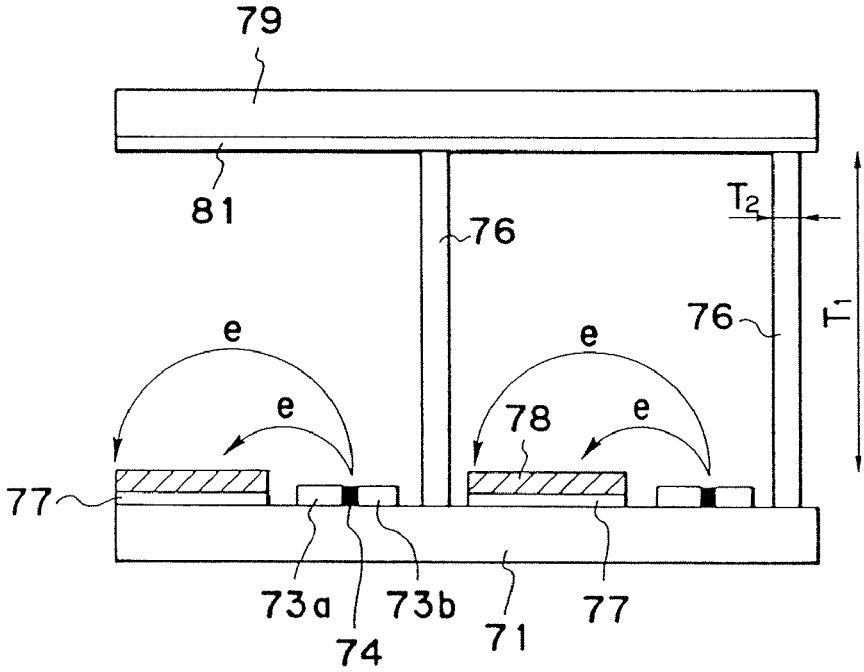
Figure 25:
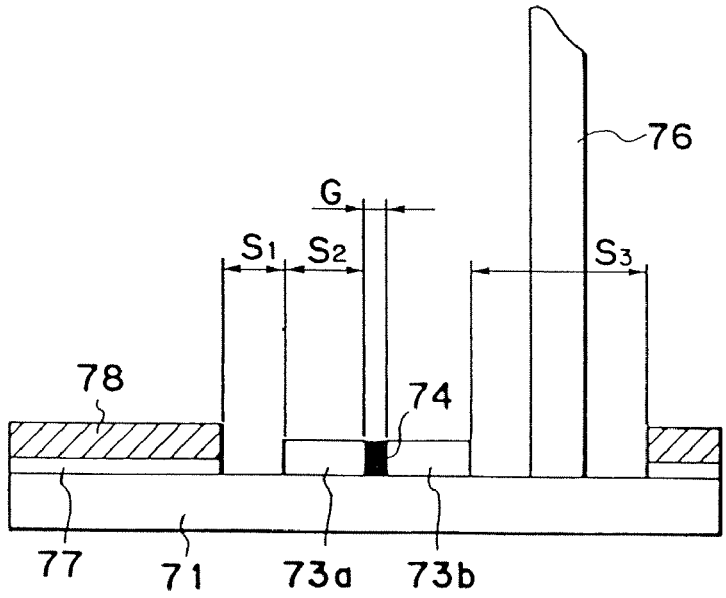

FIG. 23 is a perspective view of an image-forming device of this embodiment. FIG. 24 is a sectional view of the device illustrated in FIG. 23. This device has the same construction as that of Embodiment 10 except that an electroconductive member wall 76 is placed such that the lower end thereof is not on a negative electrode 73*b* but is on a portion of a substrate 71 between the negative electrode 73*b* and an image-forming member 78 adjacent thereto and the upper end of the electroconductive member wall comes into direct contact with a transparent electrode (a potential-defining electrode) 81. This device is prepared in the same manner as the device of Embodiment 10. Therefore, the conductive supporting member 76 is at the same potential as the transparent electrode 81.

Figure 26:
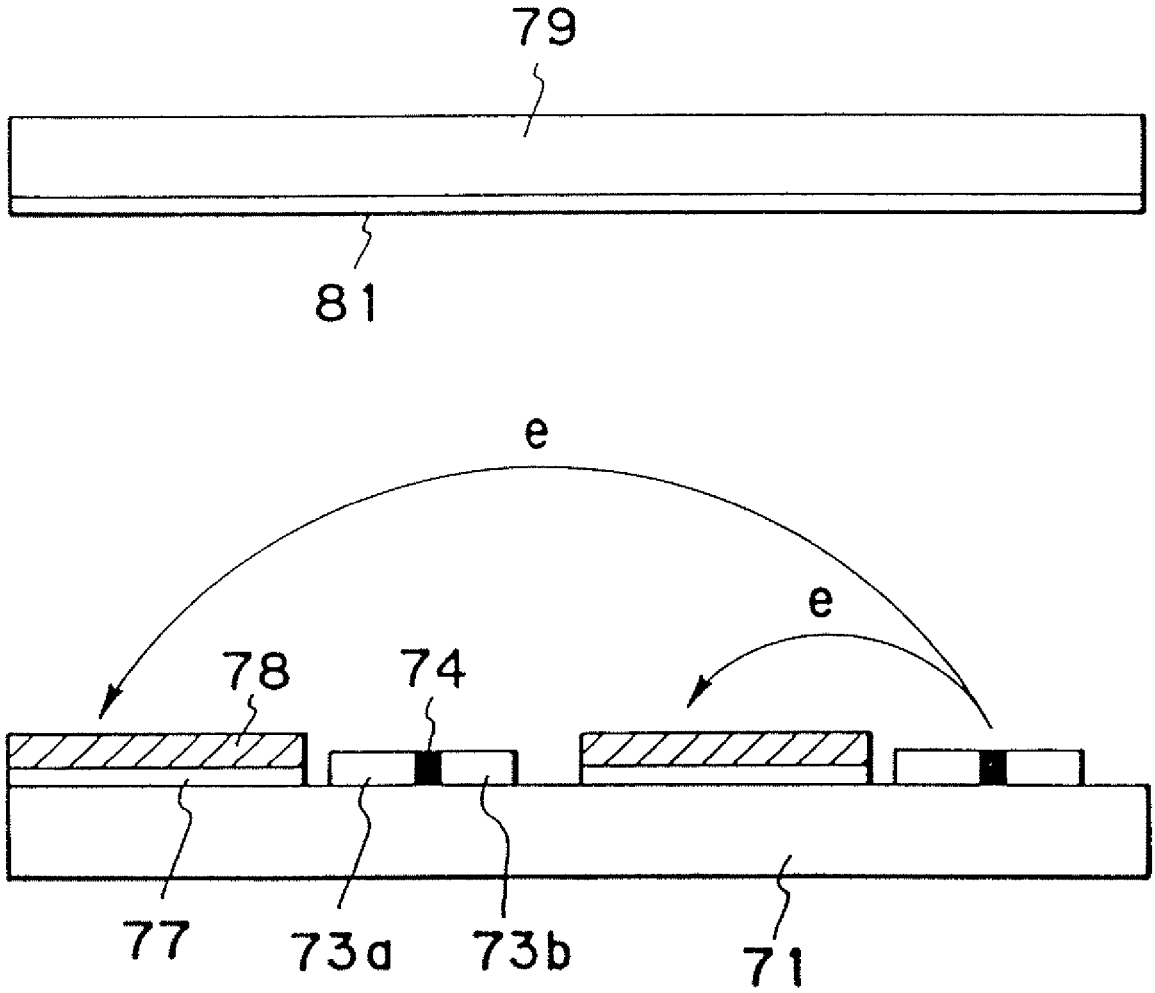

On driving, the transparent electrode 81 is set preliminarily at a potential within the range mentioned in Embodiment 10 to give satisfactory luminance and uniformity of luminescent spots. The device is driven in the same manner as in Embodiment 9. In the driving, the electron path e is as shown in FIG. 24 like in Embodiment 9, thus the same effect being obtained as in Embodiment 10 by aid of the transparent electrode 81 without crosstalk in comparison with the case of FIG. 26 having no electroconductive member wall 76.

Embodiment 12

Figure 27:
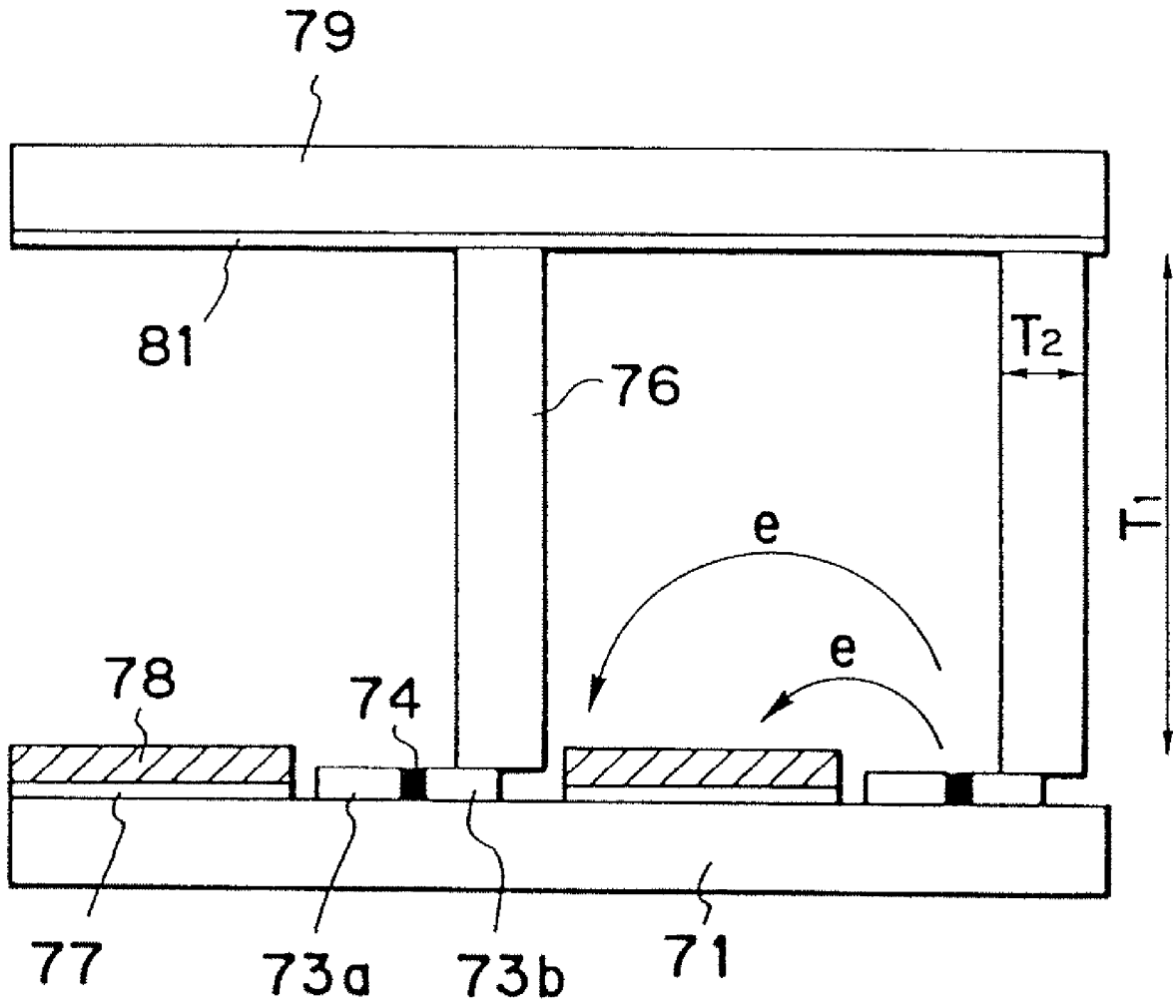

FIG. 27 is a sectional view of an image-forming device of a twelfth embodiment of the present invention. In this Embodiment, the insulator 82 is eliminated from the image-forming device of Embodiment 10, thereby the electroconductive supporting member 76 is connected with the transparent electrode 81, and the electroconductive supporting member 76 and the transparent electrode 81 being at the same potential (0 V) as the element electrode 73*b*.

The device of this Embodiment was found to give the same effect as in Embodiment 10 as the result of driving in the same manner.

Embodiment 13

Figure 28:
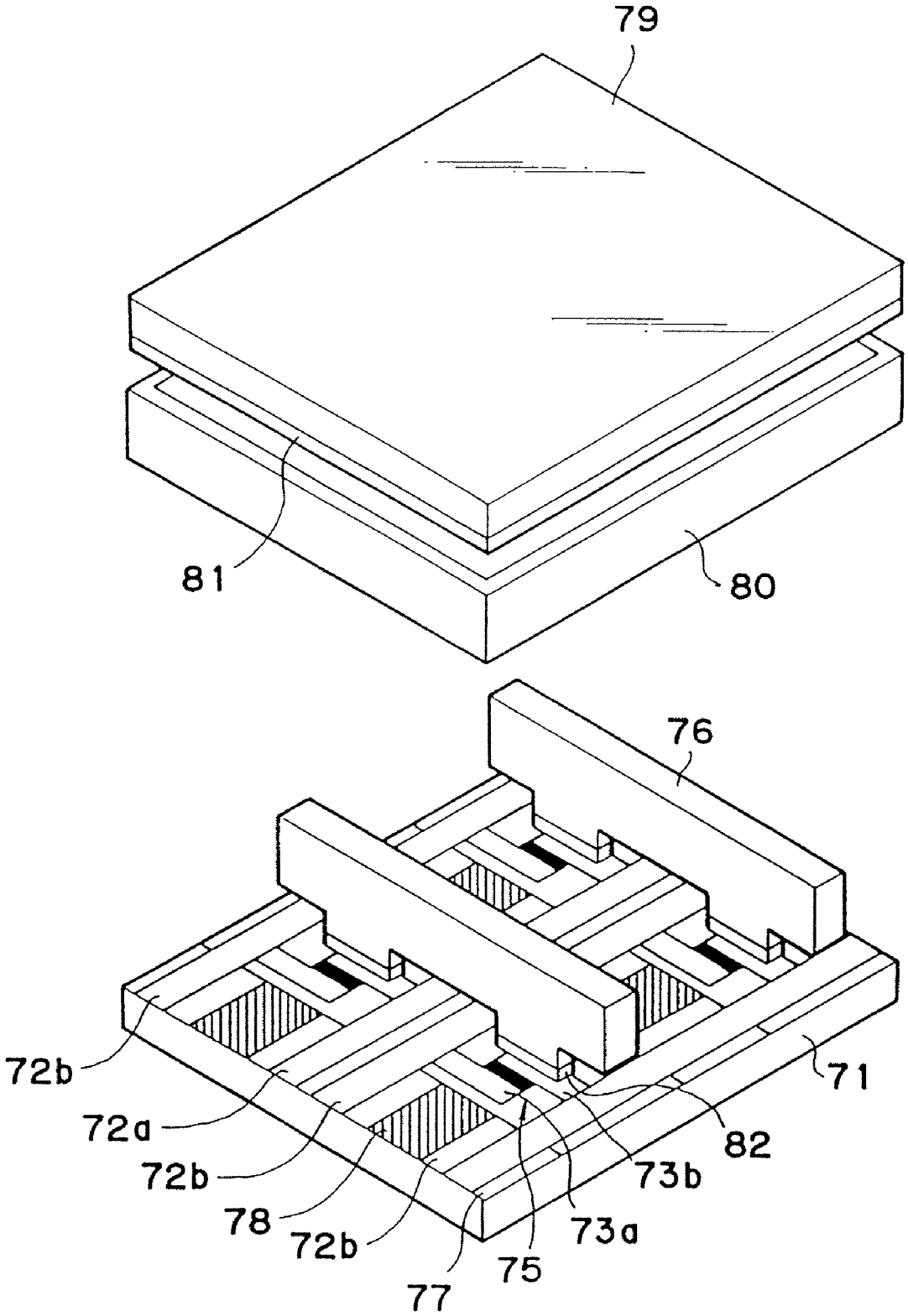
Figure 29:
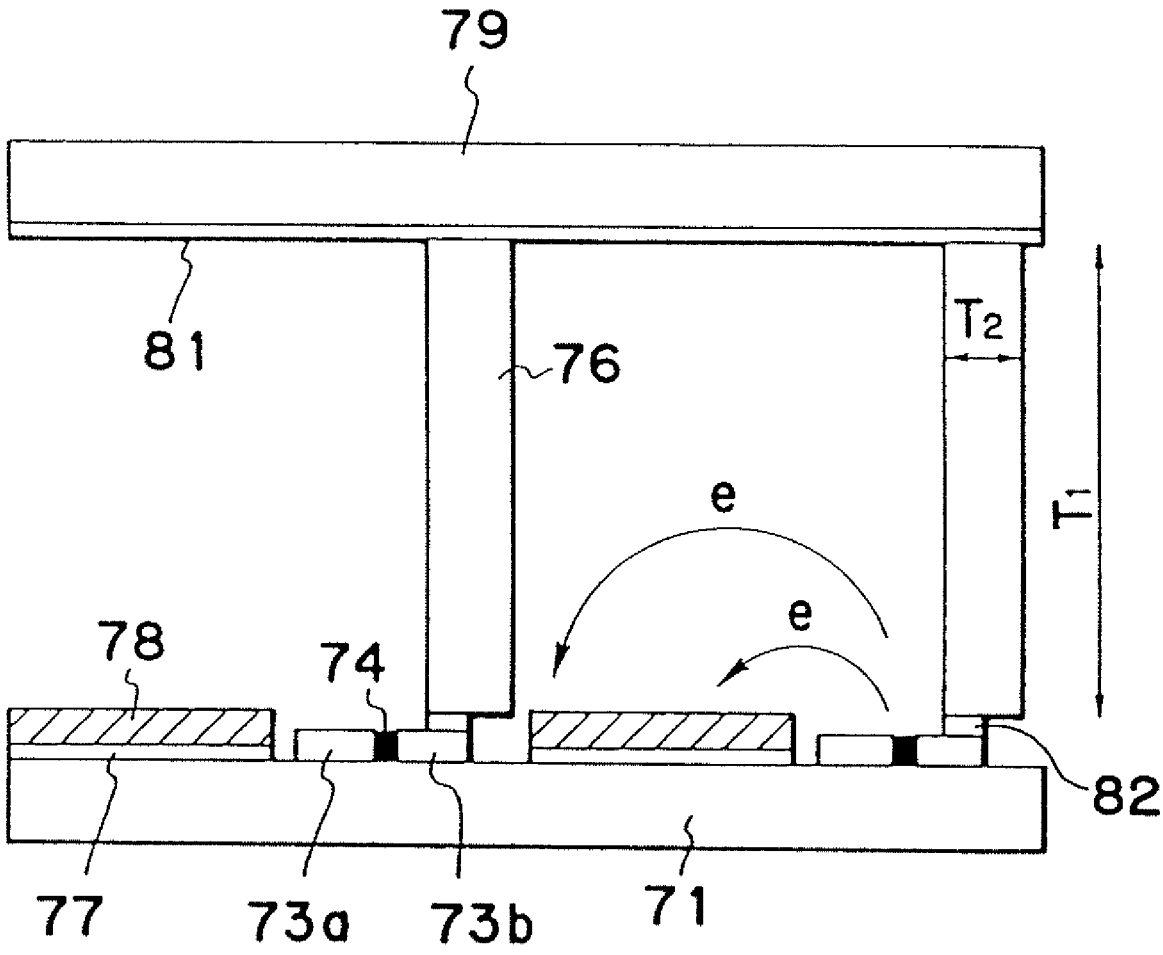

FIG. 28 is a perspective view of an image-forming device of a thirteenth Embodiment of the present invention. FIG. 29 is a sectional view of the device. This device has the same construction as that of Embodiment 12 except that the electroconductive supporting member 76 is placed on the negative electrode 73*b* and an insulator is provided between the electroconductive supporting member 76 and the negative electrode 73*b*. This device is prepared in the same manner as in Embodiment 12.

The insulator 82 serves to maintain electric insulation between the electroconductive supporting member 76 and the negative element electrode 73*b*. The insulator may be made from any insulating material such as $SiO_2$, glass and the like. In this Embodiment, it is made from $SiO_2$. The size of the insulator 82 is desired to be as small as possible provided that the electric insulation is maintained, because, with its size much larger than that of the electroconductive supporting member 76, the insulator 82 will be charged up by action of a charged beam such as ions and electrons. Therefore, the insulator 82 is preferably made smaller than the thickness $T_2$ of the electroconductive supporting member 76.

This device was evaluated by driving in the same manner as in Embodiment 9, and found that the effect is the same as that of Embodiment 9, and further that bright image display could be obtained without crosstalk even with a smaller arrangement pitch of image-forming members 78 and the electron-emitting elements 75.

Embodiment 14

Figure 30:
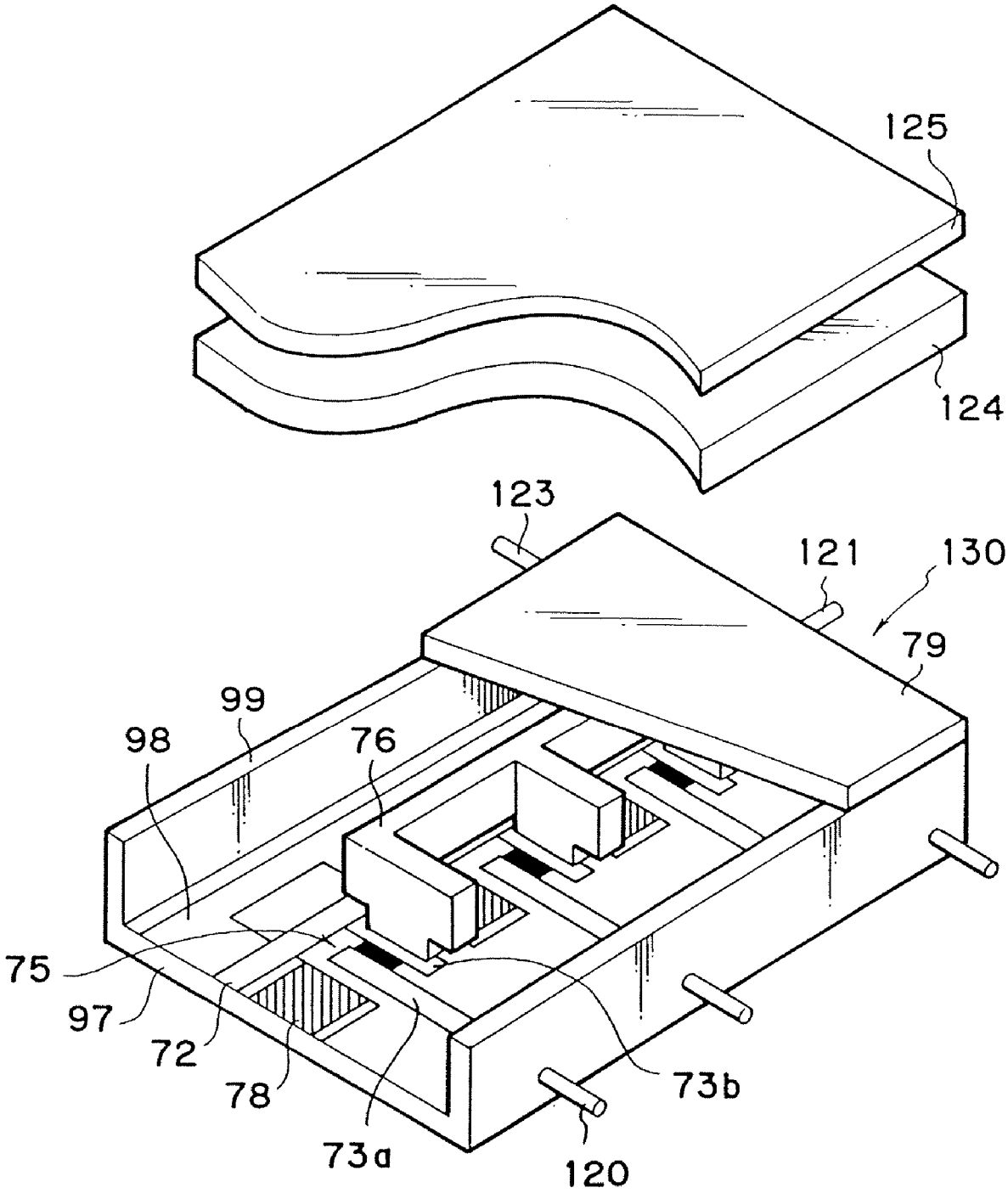
FIGS. 30 to 34 are rough sketches of optical printers among the image-forming device of the present invention.

FIG. 30 illustrates roughly the constitution of an optical printer according to a fourteenth Embodiment of the present invention. In FIG. 30, the reference numerals correspond to those in FIG. 17, denoting the same parts. This device is provided with a light source 130, a lens away 124, and a recording medium 125. The lens away is constructed generally by a SELFOC lens, and is placed between the light source 130 and the recording medium 125 to form a pattern of the light emitted by the image-forming member 78 on the recording medium 125. The light source 130 is a linear light source comprising only one row of electron-emitting elements, and is prepared in the same manner as in Embodiment 9. The electroconductive supporting member 76 is in a shape of a comb as shown in FIG. 30. The device is provided also with a vacuum glass vessel 99, a rear plate 97, an electrode 121 for applying voltage to an element-wiring negative electrode 72 of electron-emitting elements 75, electrodes 120 for applying voltage to positive element electrodes 73*a*, an image-forming member wiring electrode 48 connected to each of image-forming members 78 composed of a fluorescent material, and an electrode 123 for applying voltage to the image-forming member wiring electrode 98.

The recording medium 125 is prepared by applying uniformly a photosensitive composition in a thickness of 2 μm on a polyethylene terephthalate film. This photosensitive composition is prepared by dissolving, in 70 parts by weight of methyl ethyl ketone, a mixture of (a) 10 parts by weight of polyethylene methacrylate (tradename: Dianal BR, made by Mitsubishi Rayon Co., Ltd.) as a binder; (b) 10 parts by weight of trimethylolpropane triacrylate (tradename TMPTA, made by Shin Nakamura Kagaku K.K.) as a monomer; and (c) 2.2 parts by weight of 2-methyl-2-morpholino (4-thiomethylphenyl)propan-1-oxy (tradename: Irugacure 907, made by Ciba Geigy Co.) as a polymerization initiator. The fluorescent material constituting the image-forming member 78 employed is mainly composed of a silicate fluorescent material $(Ba,Mg,Zn)_3\ Si_2O_7{:}Pb^{2+}$.

With this construction, a voltage of 10 to 500 V is applied through the electrode 123 to the image-forming member 78, while a voltage of 0 V is applied to the negative element electrode 73*b* of the electron-emitting element 75 and also to the electroconductive supporting member 76.

In this state, a pattern of light is emitted for one line of an image, on applying modulation voltage of one line of image through the electrodes 120 to the positive element electrode 73*a* in corresponding with information signals for the image to be formed. This pattern of emitted light is projected through the lens array 124 to the recording medium 125 to form an image. Thereby photopolymerization occurs in the recording medium 125 to cause curing of the medium and formation of one line of image. Then the light-emitting source 130 and the recording medium 125 move relatively for one line of image, and next one line of image is formed in the same manner. Such steps of image formation and relative movement are repeated to complete the whole image.

The synchronous movement of the light-emitting source 130 relative to the recording medium 125 may be conducted by driving the recording medium supported by a supporting member 87 by means of a conveying roller 85 as shown in FIG. 31, or otherwise by moving the light-emitting source 83 as shown in FIG. 32. In either synchronous movement, a photopolymerization pattern is formed on the recording medium in accordance with the information signal. Therefrom, an optical recording pattern is formed on the polyethylene terephthalate film in accordance with the information signal.

In this Embodiment, a sharp and uniform optical recording pattern is obtained at a high speed with high contrast, and with high resolution without crosstalk owing to the provision of electroconductive supporting member 76.

Additionally, an optical printer having a similar effect is produced by utilizing the construction of any of Embodiment 1 to 4 as the light-emitting source for the optical printer of this Embodiment.

Embodiment 15

FIG. 33 illustrates roughly the construction of an optical printer according to a fifteenth embodiment of the present invention. This apparatus has a light-emitting source 83 and a lens array 84 operating similarly as that of Embodiment 14, a drum-shaped electrophotographic sensitive member 89 as the recording medium, an electrifier 94, a developer 90, a static eliminator 91, and a cleaner 93, and forms an image finally on a paper sheet. The fluorescent material used for the light-emitting source 83 is a yellowish green fluorescent material, $Zn_2SiO_4$:Mn (P1 fluorescent material). The electrophotographic sensitive member 89 is made of an amorphous silicon sensitive material.

With this construction, as described above, the recording medium 89 rotates synchronously relative to the light-emitting source 83 in the direction indicated by the arrow mark 92*b*, and simultaneously the paper sheet 95 also moves synchronously in the direction indicated by the arrow mark 92*a*. During the rotation, the recording medium 89 is electrified positively by the electrifier 94, a patterned light is projected imagewise from the light-emitting source 83 through the lens array 84 to remove static charge at the irradiated portion to form a static latent image pattern. The electrifying voltage is suitably in a range of from 100 to 500 V, but is not limited thereto. This latent image pattern is developed with toner particles by means of a developing device 90. The adhering toner moves with the rotation of the recording medium 89, and falls on to the paper sheet 95 placed between the recording medium 89 and the static eliminator 91 on eliminating the static charge by the static eliminator 91. Thereafter the paper sheet having received the toner is subjected to a fixing treatment to reproduce on the paper sheet 95 the image having been formed by the light-emitting source 83. The toner remaining on the recording medium 89 is cleaned off by the cleaner 93, and again electrified by the electrifier 94.

In this Embodiment, a sharp image is formed with high contrast and high resolution without uneveness of light exposure at a high speed, owing to the advantage of the light-emitting source 83. Furthermore, owing to the aforementioned effect of the electroconductive supporting member 76, a toner image of high quality is formed without running of the image.

Additionally, an optical printer having a similar effect is produced by utilizing the construction of any of Embodiments 1 to 4 as the light-emitting source for the optical printer of this Embodiment.

Embodiment 16

Figure 34:
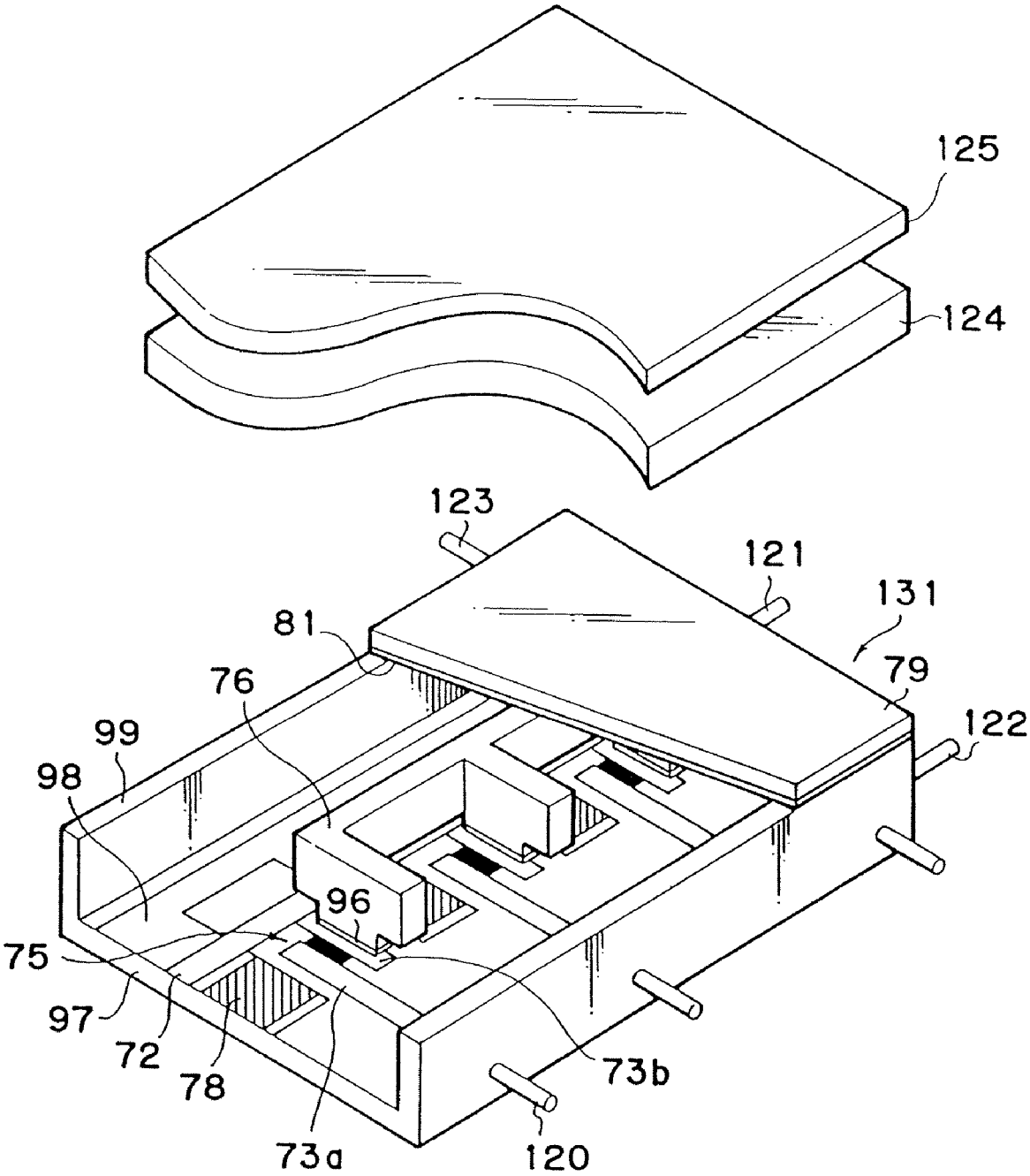
Figure 35:
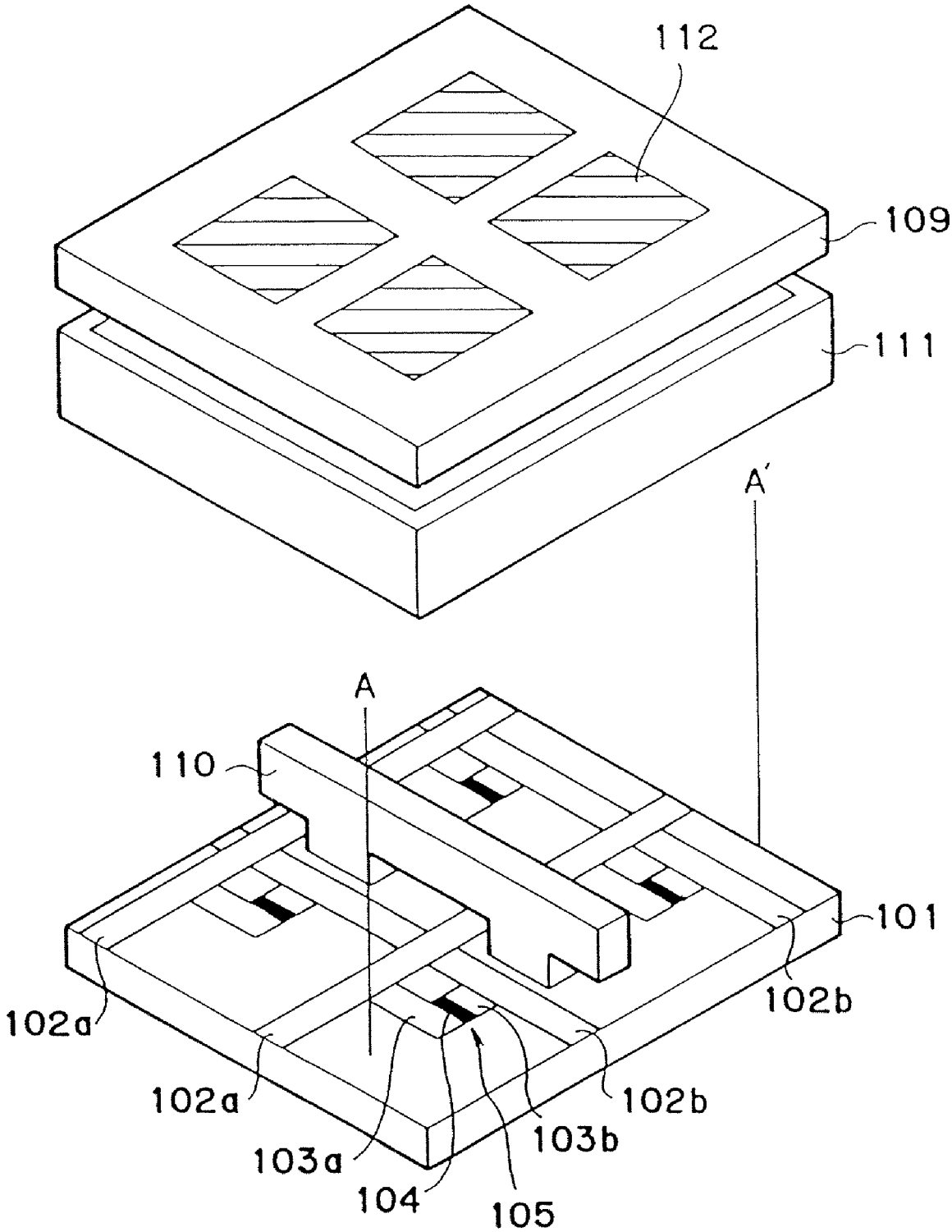
FIG. 35 (PRIOR ART)
FIG. 35 to 37 are rough sketches of conventional image-forming devices.
Figure 36:
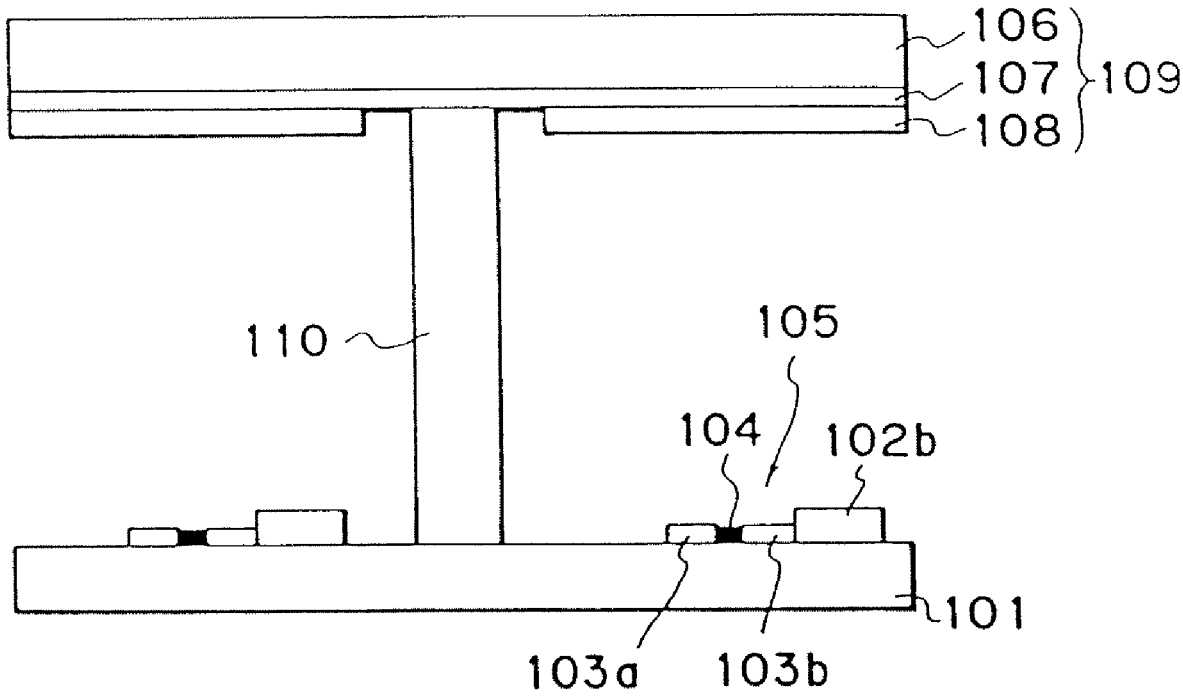
FIG. 36 (PRIOR ART)
Figure 37:
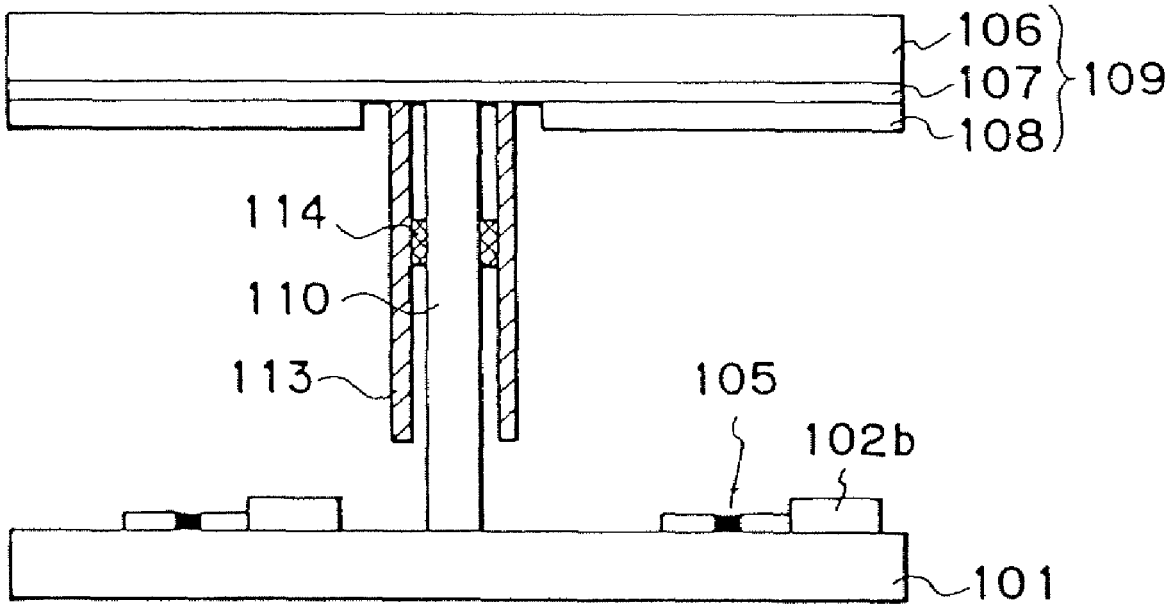
FIG. 37 (PRIOR ART)

FIG. 34 illustrates roughly the constitution of an optical printer according to a sixteenth embodiment of the present invention. This device has the same constitution as that of Embodiment 14 except that a transparent electrode 81 is additionally provided on the face plate 79 which is brought into contact with the electroconductive supporting member 76, and an insulator 96 is provided between the electroconductive supporting member 76 and the negative electrode 73*b*. This device is prepared in the same manner as in Embodiment 14. Although not shown in the drawings, a power source is provided to apply voltage through the electrode 122 to the transparent electrode 81.

This device is driven in the same manner as that in Embodiment 14 except that an appropriate voltage is applied preliminarily through the electrode 122 to the transparent electrode 81, and the electroconductive supporting member 76 is at the same potential as the transparent electrode 81.

In this Embodiment, not only the same effect as in Embodiment 14 is obtained, but also finer and higher-quality image display is attained. Further, by using this device 131 as the light-emitting source 83, finer and higher-quality image is obtained.

The image-forming device of the present invention gives uniform and stable images without crosstalk and time-variation. Further, with this device, a lighter weight of an apparatus and a larger size of a screen can be obtained by reducing the thicknesses of the members for forming the vacuum envelop. In particular, in a displaying apparatus employing a fluorescent material for the image-forming member, the device of the present invention gives images with fidelity to information signals, little luminance variation, little unevenness of luminance, and little irregularity of color tone.

In particular, in a device having the electron-emitting member and the image-forming member on the same substrate, the advantages below are obtained: the damage of the electron-emitting device being prevented because of non-occurrence of collision of positive ions against the electron-emitting element; no strict registration of the positions of the electron-emitting element and the image-forming member being required, thereby the image-forming member being placed extremely easily; and no variation of relative position of the electron-emitting elements to the image-forming member occurring after completion of the device.

What is claimed is:

1. An image-forming device comprising:

a rear plate having an electron-emitting element of lateral or vertical field-emitting type for emitting an electron by applying a voltage between electrodes;

a face plate having an image-forming member for forming an image by irradiation with an electron beam emitted from said electron-emitting element; and a supporting member placed between the rear plate and the face plate for supporting the rear plate and the face plate, wherein said supporting member comprises an electroconductive film extending continuously from an end portion of the supporting member opposite to the rear plate along a side portion of the supporting member and contacting with the face plate, and is electrically connected through the electroconductive film at the end portion to at least one electrode.

2. An image-forming device comprising:

a rear plate having a plurality of electron-emitting elements of lateral or vertical field-emitting type for emitting an electron by applying a voltage between electrodes, and a plurality of wirings for connecting said electron-emitting elements;

a face plate having an image-forming member for forming an image by irradiation with an electron beam emitted from said electron-emitting elements; and a supporting member placed between the rear plate and the face plate for supporting the rear plate and the face plate, wherein said supporting member comprises an electroconductive film extending continuously from an end portion of the support member opposite to the rear plate along a side portion of the supporting member and contacting with the face plate, and is electrically connected through the electroconductive film at the end portion to at least one of said wirings.

3. An image-forming device comprising, in an envelope:

a plurality of electron-emitting elements for emitting electrons by applying a voltage between electrodes of the electron emitting elements;

a plurality of wirings for connecting the plurality of electron-emitting elements;

an imager forming member for forming an image by irradiation with the electrons emitted from the plurality of electron-emitting elements; and an electroconductive supporting member for supporting the envelope, wherein the supporting member is electrically connected to more than one but not all of the plurality of wirings.

4. An image-forming device comprising, in an envelope:

a plurality of electron-emitting elements for emitting electrons by applying a voltage between electrodes of the electron emitting elements;

a plurality of wirings for connecting the plurality of electron-emitting elements;

an imager forming member for forming an image by irradiation with the electrons emitted from the plurality of electron-emitting elements; and a supporting member for supporting the envelope, wherein the supporting member has an electroconductive film at an end portion and a side portion of the supporting member, and is electrically connected through the electroconductive film at the end portion to more than one but not all of the plurality of wirings.

* * * * *